US012303094B2

(12) United States Patent
Pruiett

(10) Patent No.: US 12,303,094 B2
(45) Date of Patent: May 20, 2025

(54) SURFACE CLEANING APPARATUS

(71) Applicant: BISSELL Inc., Grand Rapids, MI (US)

(72) Inventor: Jason W. Pruiett, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/745,099

(22) Filed: Jun. 17, 2024

(65) Prior Publication Data

US 2024/0335073 A1 Oct. 10, 2024

Related U.S. Application Data

(62) Division of application No. 17/882,731, filed on Aug. 8, 2022, now Pat. No. 12,035,873.

(60) Provisional application No. 63/238,864, filed on Aug. 31, 2021.

(51) Int. Cl.
*A47L 9/04* (2006.01)
*A47L 5/30* (2006.01)

(52) U.S. Cl.
CPC ..... *A47L 9/0477* (2013.01); *A47L 5/30* (2013.01); *A47L 9/0411* (2013.01)

(58) Field of Classification Search
CPC ..... A47L 9/0477; A47L 5/30; A47L 9/0411; A47L 11/408; A47L 7/0009
See application file for complete search history.

(56) References Cited

U.S. PATENT DOCUMENTS 3,545,875 A * 12/1970 Schneider ..... A47L 11/4041 222/414
4,959,628 A * 9/1990 MacGregor ..... A47L 11/4041 335/207
6,041,472 A * 3/2000 Kasen ..... B01F 25/105 15/355
6,081,962 A * 7/2000 Kasen ..... C11D 3/3905 96/406
6,968,593 B1 * 11/2005 Lenkiewicz ..... A47L 7/0042 15/384
7,979,952 B2 * 7/2011 Beskow ..... A47L 11/302 15/322
9,668,628 B2 * 6/2017 Kasper ..... A47L 9/1683
9,820,627 B2 * 11/2017 Caro, Jr. ..... A47L 11/4088
10,092,155 B2 * 10/2018 Xia ..... A47L 11/4086
10,136,781 B2 * 11/2018 Li ..... A47L 11/4041
2003/0051301 A1 * 3/2003 Morgan ..... A47L 9/0433 15/49.1

(Continued)

FOREIGN PATENT DOCUMENTS

EP 3079553 B1 12/2013
EP 3679845 A1 7/2020

(Continued)

*Primary Examiner* — Marc Carlson
(74) *Attorney, Agent, or Firm* — Warner Norcross + Judd LLP

(57) ABSTRACT

A surface cleaning apparatus includes a housing including a base adapted for movement across a surface to be cleaned, a fluid delivery system, and a recovery system. The surface cleaning apparatus can be configured to clean multiple surfaces, including hard and soft surfaces, and for different cleaning modes, including wet cleaning, dry vacuum cleaning, and self-cleaning. A brushroll is provided on the base, along with various wipers, squeegees, and/or fluid dispensers.

20 Claims, 25 Drawing Sheets

(56) References Cited

U.S. PATENT DOCUMENTS

| | | | | |
|---|---|---|---|---|
| 2019/0246860 | A1* | 8/2019 | Li | A47L 11/4088 |
| 2021/0186283 | A1* | 6/2021 | Nguyen | A47L 9/30 |
| 2023/0064666 | A1* | 3/2023 | Pruiett | A47L 7/0009 |

FOREIGN PATENT DOCUMENTS

| | | | | |
|---|---|---|---|---|
| EP | 3834693 | A1 | 6/2021 | |
| EP | 4059399 | A1 * | 9/2022 | A47L 11/302 |
| JP | 2008188319 | A * | 8/2008 | A47L 9/0427 |
| KR | 20140110530 | A | 9/2014 | |
| WO | WO-2008074014 | A2 * | 6/2008 | A47L 11/302 |
| WO | 2013027164 | A1 | 2/2013 | |
| WO | WO-2021123829 | A1 * | 6/2021 | A47L 11/08 |

* cited by examiner

SURFACE CLEANING APPARATUS

CROSS-REFERENCE TO RELATED APPLICATION(S)

This application is a divisional of U.S. patent application Ser. No. 17/882,731, filed Aug. 8, 2022, which claims the benefit of U.S. Provisional Patent Application No. 63/238,864, filed Aug. 31, 2021, both of which are incorporated herein by reference in their entirety.

BACKGROUND

Multi-surface vacuum cleaners are adapted for cleaning hard floor surfaces such as tile and hardwood and soft floor surfaces such as carpet and upholstery. Some multi-surface vacuum cleaners comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other multi-surface cleaning apparatuses include "dry" vacuum cleaners, which can clean different surface types, but do not dispense or recover liquid. Yet other floor cleaners include "wet" cleaners such as steam and hard floor cleaners that dispense cleaning fluid but may or may not apply suction to remove liquid and debris from the surface.

BRIEF SUMMARY

A surface cleaning apparatus is provided herein. In certain embodiments, the surface cleaning apparatus is a multi-surface wet/dry vacuum cleaner that can be used to clean hard floor surfaces such as tile and hardwood and soft floor surfaces such as carpet.

According to one aspect of the disclosure, a surface cleaning apparatus is provided with a fluid dispenser comprising a porous spray bar configured to deliver cleaning fluid onto a brushroll. The porous spray bar can be integrated with a nozzle cover or with a base to which a nozzle cover is coupled, and may be positioned to interfere with the brushroll.

In this and other aspects, the brushroll may be a hybrid brushroll that includes multiple agitation materials to optimize cleaning performance on different types of surfaces to be cleaned, including hard and soft surfaces, and for different cleaning modes, including wet and dry vacuum cleaning.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The invention generally relates to a surface cleaning apparatus for cleaning floor surfaces such as carpets, area rugs, wood, tile, and the like, and arrangements for removing excess liquid from brushroll and/or wiping liquid from a surface to be cleaned.

Figure 1:
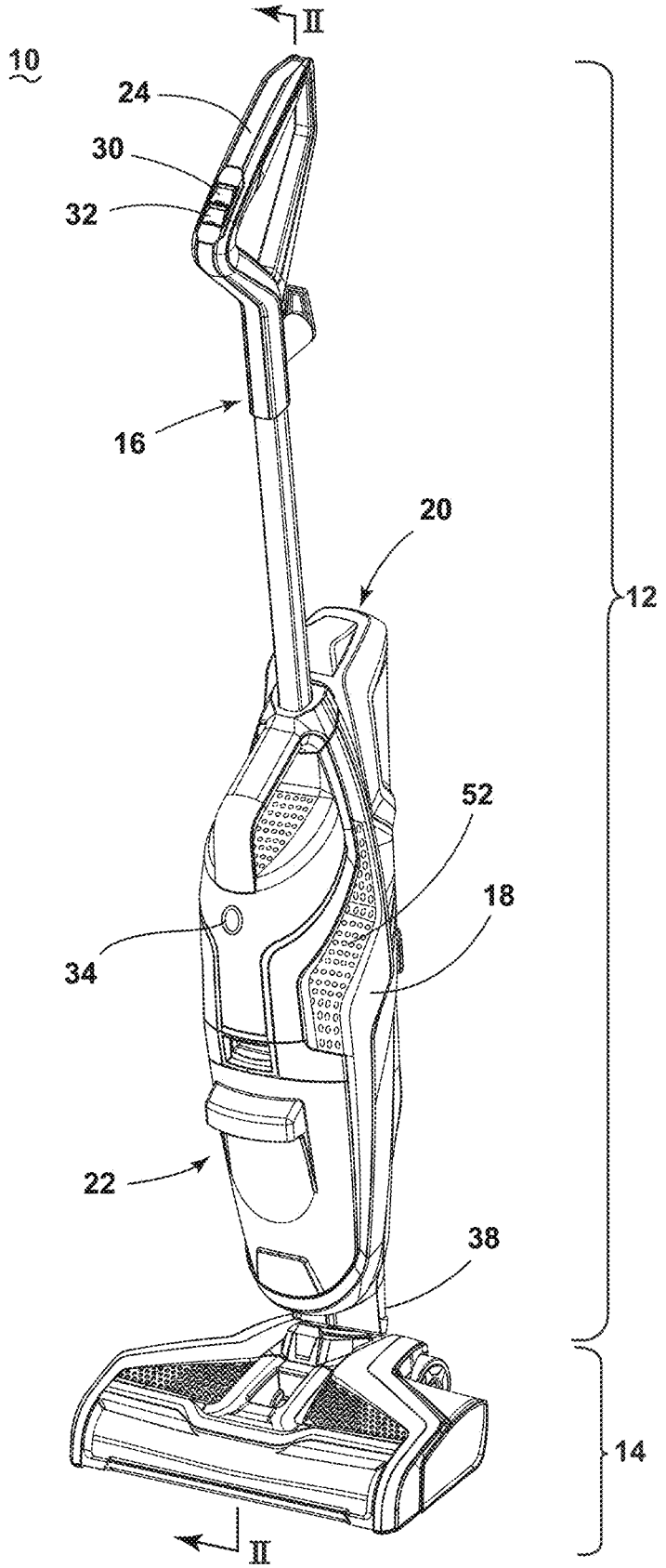
FIG. 1 is a perspective view of a surface cleaning apparatus having a base according to an aspect of the disclosure.
Figure 2:
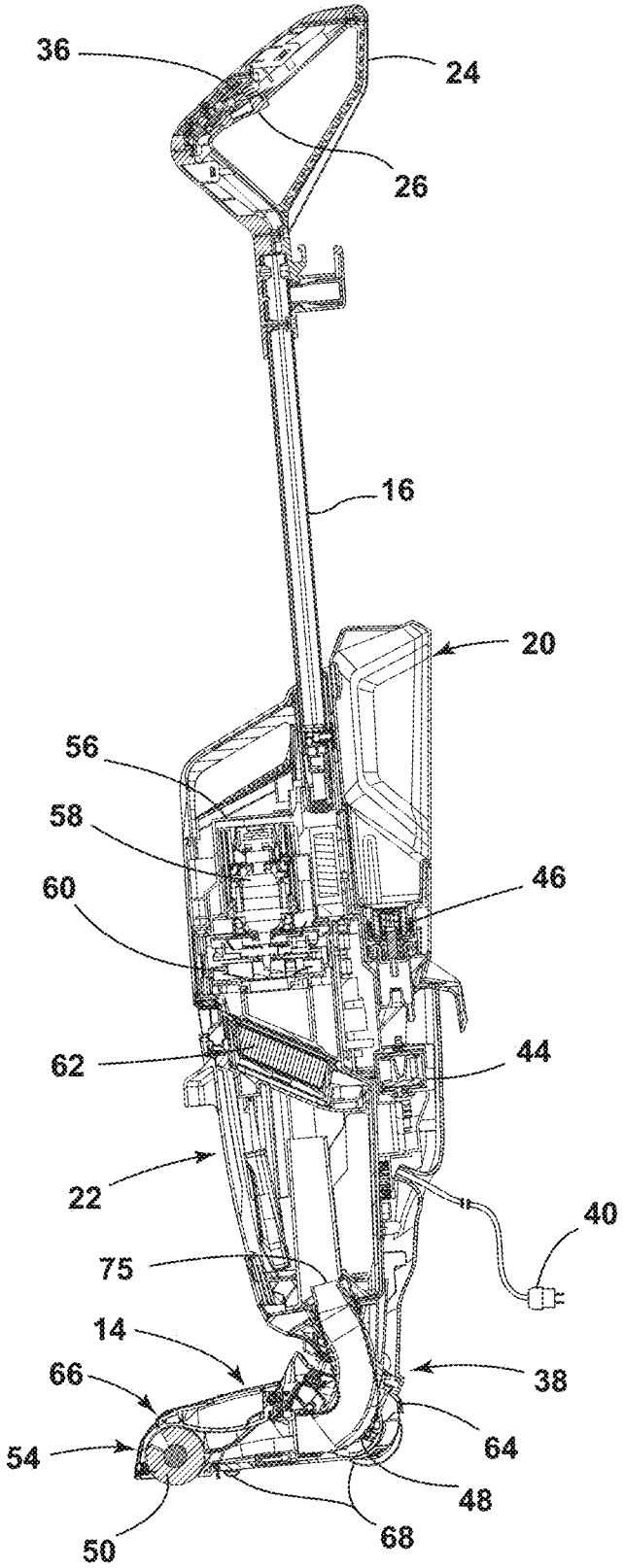
FIG. 2 is a cross-sectional view of the surface cleaning apparatus taken through line II-II of FIG. 1.

FIGS. 1-2 show a surface cleaning apparatus 10 according to one aspect of the present disclosure. As discussed in further detail below, the surface cleaning apparatus 10 is provided with various features and improvements, including wipers, squeegees, and/or fluid dispensers that can reliably collect debris of varying size, remove excess liquid from brushroll, and/or wipe residual liquid from the floor surface to be cleaned, thereby leaving a clean and streak-free floor surface.

The functional systems of the apparatus 10 can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source.

As illustrated herein, the apparatus 10 can be an upright multi-surface wet/dry vacuum cleaner having a housing that includes an upright handle assembly or body 12 and a cleaning head or base 14 mounted to or coupled with the upright body 12 and adapted for movement across a surface to be cleaned. As used herein, the term "multi-surface wet/dry vacuum cleaner" includes a vacuum cleaner that can be used to clean hard floor surfaces such as tile and hardwood and soft floor surfaces such as carpets and area rugs.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user behind the apparatus 10, which defines the rear of the apparatus 10. However, it is to be understood that the disclosure may assume various alternative orientations, except where expressly specified to the contrary.

The upright body 12 can comprise a handle 16 and a frame 18. The frame 18 can comprise a main support section supporting at least a supply tank 20 and a recovery tank 22, and may further support additional components of the body 12. The surface cleaning apparatus 10 can include a fluid delivery or supply pathway, including and at least partially defined by the supply tank 20, for storing cleaning fluid and delivering the cleaning fluid to the surface to be cleaned and a recovery pathway, including and at least partially defined by the recovery tank 22, for removing the spent cleaning fluid and debris from the surface to be cleaned and storing the spent cleaning fluid and debris until emptied by the user.

The handle 16 can include a hand grip 24 and a trigger 26 mounted to the hand grip 24, the trigger 26 controlling the dispensing of fluid from a fluid delivery system including the supply tank 20 via an electronic or mechanical coupling with the tank 20. Other actuators for the fluid delivery system, such as a thumb switch, can be provided instead of the trigger 26.

The apparatus 10 can include at least one user interface (UI) through which a user can interact with the apparatus 10 and/or receive feedback information from the apparatus 10. The UI can be electrically coupled with electrical components, including, but not limited to, circuitry electrically connected to various components of the fluid delivery and recovery systems of the surface cleaning apparatus 10, as described in further detail below.

In the illustrated embodiment, the apparatus 10 includes a UI with multiple input controls 30, 32 on the hand grip 24. One control 30 is a power button that controls the supply of power to one or more electrical components of the apparatus 10 and the other control 32 is a cleaning mode button that cycles the apparatus 10 between different cleaning modes. Some examples of cleaning modes include a hard floor cleaning mode and an area rug or carpet cleaning mode. In one example, in each cleaning mode a pump 44, vacuum motor 58, and brushroll motor 72 are activated, with the vacuum motor operating at a lower power level and the pump operating at a lower flow rate in the hard floor mode. Those rates increase in the area rug cleaning mode. Other cleaning modes are possible. Other input controls, such as but not limited to buttons, triggers, toggles, keys, switches, or the like, and other locations for the UI are possible.

The apparatus 10 can include a self-cleaning mode input control 34, which initiates a self-cleaning mode of operation in which an unattended, automatic self-cleaning cycle runs. In one example, during the self-cleaning cycle, the apparatus 10 is docked on a tray and the pump 44, vacuum motor 58, and/or brushroll motor 72 operate to flush out portions of the recovery pathway of the recovery system and clean a brushroll 50 or other agitator. The input control 34 can comprise a button, trigger, toggle, key, switch, or the like, or any combination thereof, and can be located adjacent to the power button 30 and/or cleaning mode button 32, or can be remote from the buttons 30, 32 as shown. For example, the self-cleaning mode input control 34 can be located on the upright body 12, or more specifically on the handle 16 or frame 18.

The apparatus 10 can include a controller 36 operably coupled with the various functional systems of the apparatus, including, but not limited to, the fluid delivery and recovery systems, for controlling its operation. A user of the apparatus 10 can interact with the controller 36 via the UI and/or buttons 30, 32, and 34. The controller 36 can further be configured to execute the self-cleaning cycle for the self-cleaning mode of operation. The controller 36 can have software for executing the self-cleaning cycle. In the embodiment shown in FIG. 2, the controller 36 is disposed inside the hand grip 24, although other locations are possible.

A moveable joint assembly 38 can be formed at a lower end of the frame 18 and moveably mounts the base 14 to the upright body 12. In the embodiment shown herein, the upright body 12 can pivot up and down about at least one axis relative to the base 14. The joint assembly 38 can alternatively comprise a universal joint, such that the upright body 12 can pivot about at least two axes relative to the base 14. Wiring and/or conduits can optionally supply electricity, air and/or liquid (or other fluids) between the base 14 and the upright body 12, or vice versa, and can extend though the joint assembly 38. The upright body 12 can pivot, via the joint assembly 38, to an upright or storage position, an example of which is shown in FIG. 1-2, and a reclined or use position (not shown), in which the upright body 12 is pivoted rearwardly relative to the base 14 to form an acute angle with the surface to be cleaned. In this position, a user can partially support the apparatus by holding the hand grip 24.

The apparatus 10 can be powered by a power supply, such as a power cord 40 plugged into a household power outlet. In yet another embodiment, the apparatus 10 can be powered by a battery, preferably a rechargeable battery, for cordless operation.

The fluid delivery system of the apparatus 10 is configured to deliver cleaning fluid from the supply tank 20 to a surface to be cleaned, and can include a fluid delivery or supply pathway. The supply tank 20 includes a supply chamber for holding cleaning fluid. The cleaning fluid can comprise one or more of any suitable cleaning liquids, including, but not limited to, water, compositions, concentrated detergent, diluted detergent, etc., and mixtures thereof. For example, the liquid can comprise a mixture of water and concentrated detergent. Alternatively, supply tank 20 can include multiple supply chambers, such as one chamber containing water and another chamber containing a cleaning agent. As yet another alternative, the apparatus 10 can comprise multiple supply tanks. It is noted that while the apparatus 10 described herein is configured to deliver a cleaning liquid, aspects of the disclosure may be applicable to floor cleaner that deliver steam. Thus, the term "cleaning fluid" may encompass both liquid and steam unless otherwise noted.

The fluid delivery system can comprise a flow control system for controlling the flow of cleaning fluid from the supply tank 20 to a distributor 42 (FIG. 4) configured to distribute or dispense the fluid. In one configuration, the flow control system can comprise the pump 44, which pressurizes the system. The pump 44 can be positioned within the upright body 12 or within the base 14, and is in fluid communication with the supply tank 20, for example via conduit (not shown). In another configuration, the pump 44 can be eliminated and the flow control system can comprise a gravity-feed system having a valve fluidly coupled with an outlet of the supply tank 20, whereby when valve is open, cleaning fluid will flow under the force of gravity to the distributor 42.

The fluid delivery system can include a supply valve 46 controlling fluid flow from an outlet of the supply tank 20 to the pump 44. For a removable supply tank 20, the supply valve 46 can be configured to automatically open when the supply tank 20 is seated apparatus 10 to release fluid to the fluid delivery pathway.

The trigger 26 can be operably coupled with the flow control system such that pressing the trigger 26 will deliver cleaning fluid to the distributor 42. For example, the delivery system can include a valve (not shown) in the fluid pathway extending between the pump 44 and the distributor 42, and the trigger 26 can selectively open the valve to permit fluid to flow out of the distributor 42.

Optionally, a heater (not shown) can be provided for heating the cleaning fluid prior to delivering the cleaning fluid to the surface to be cleaned. In one example, an in-line heater can be located downstream of the supply tank 20 and the pump 44. Other types of heaters can also be used. In yet another example, the cleaning fluid can be heated using exhaust air from a motor-cooling pathway of the recovery system.

The recovery system is configured to remove liquid and debris from the surface to be cleaned and store the liquid and debris on the apparatus 10 for later disposal, and can include a recovery pathway having at least a dirty inlet and a clean air outlet. The pathway can be formed by, among other elements, a suction nozzle 54 defining the dirty inlet, a suction source 56 in fluid communication with the suction nozzle 54 for generating a working air stream, which may contain entrained liquid and/or debris, the recovery tank 22, and at least one exhaust vent 52 defining the clean air outlet. At least a portion of the recovery pathway between the suction nozzle 54 and the tank 22 can be formed by a conduit 48. A brushroll 50 is disposed in the recovery pathway at the suction nozzle 54. Other arrangements for the recovery pathway are possible.

The recovery tank 22 is a working air treatment assembly, and removes liquid and debris from the working airstream and collects the liquid and debris for later disposal. It is understood that other types of working air treatment assemblies for removing and collecting debris and/or liquid from the working airstream for later disposal can be used, such as a cyclonic separator, a centrifugal separator, a bulk separator, a filter bag, or a water-bath separator. The type of working air treatment assembly may depend on the type of floor cleaner, whether the apparatus performs dry cleaning, wet cleaning, or both, and so on.

The suction nozzle 54 can be provided on the base 14 and is adapted to be adjacent the surface to be cleaned as the base 14 moves across a surface, and is in fluid communication with the recovery tank 22, for example through conduit 48. A brushroll 50 can be disposed in suction nozzle 54, and therefore in the recovery pathway, with the brushroll 50 agitating the surface to be cleaned so that the debris is more easily ingested into the suction nozzle 54. The suction nozzle 54 positioned to recover liquid and debris indirectly from the floor surface via the brushroll 50. In other embodiments, the brushroll 50 can be outside the recovery pathway, for example to mop the floor surface, with the suction nozzle 54 positioned to recover liquid and debris directly from the floor surface.

While a single horizontally-rotating brushroll 50 is shown herein, in some embodiments, dual horizontally-rotating brushrolls or one or more vertically-rotating brushrolls can be provided on the apparatus 10.

The suction source 56, which can be a motor/fan assembly including a vacuum motor 58 and a fan 60, is provided in fluid communication with the recovery tank 22. The suction source 56 can be positioned within the frame 18, such as above the recovery tank 22, and is fluidly downstream of the recovery tank 22. The recovery system can also be provided with one or more additional filters upstream or downstream of the suction source 56. For example, in the illustrated embodiment, a pre-motor filter 62 is provided in the recovery pathway downstream of the recovery tank 22 and upstream of the suction source 56. A post-motor filter (not shown) can be provided in the recovery pathway downstream of the suction source 56 and upstream of the clean air outlet 52.

Figure 3:
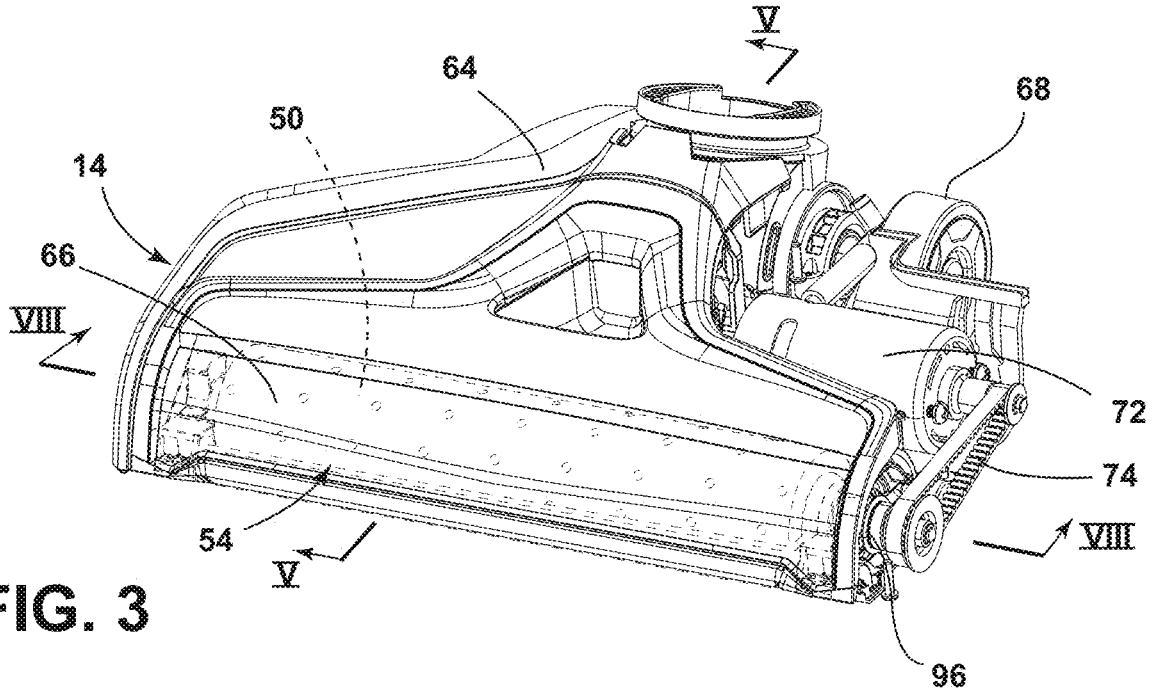
FIG. 3 is a perspective view of the base of FIG. 1, with portion of the base hidden to show internal details of the base.
Figure 4:
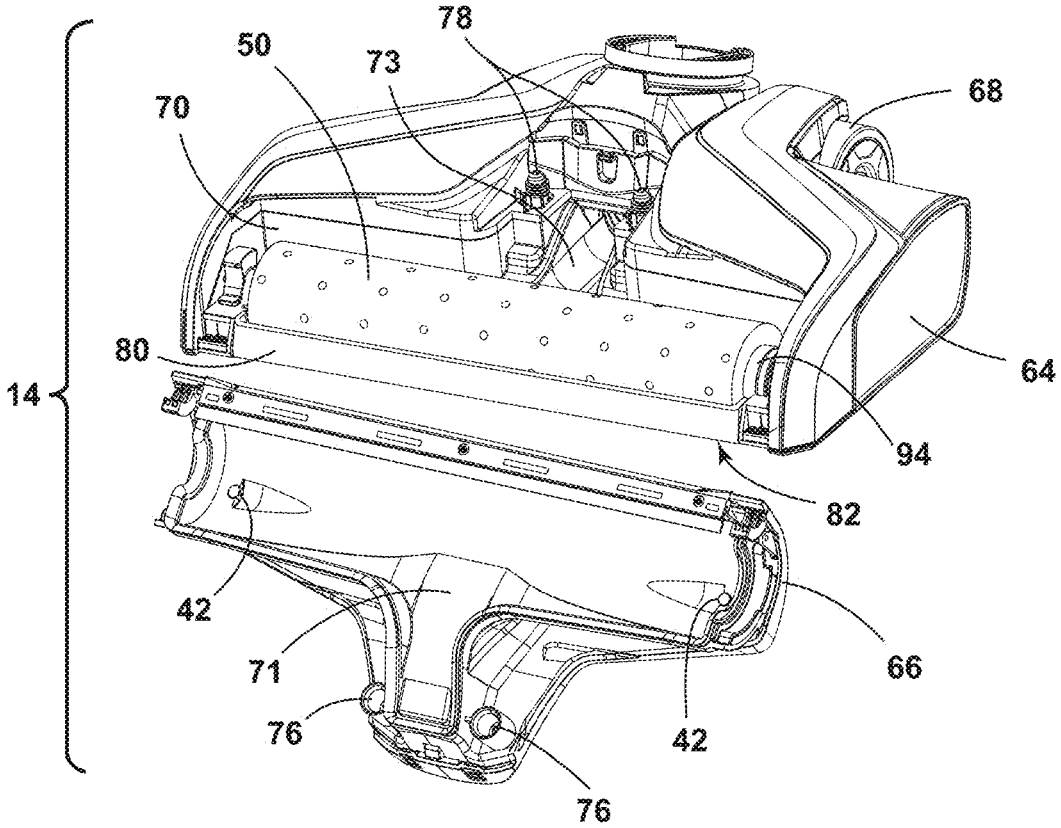
FIG. 4 is a perspective view of the base, showing a nozzle cover removed from a base housing.

Referring to FIG. 3-4, the base 14 can include a base housing 64 supporting at least some of the components of the fluid delivery system and fluid recovery system and the suction nozzle 54 can comprise a nozzle cover 66 coupled with the base housing 64. Optionally, the base housing 64 includes one or more wheels 68 for moving the apparatus 10 over the surface to be cleaned. The nozzle cover 66 can therefore define a portion of the recovery pathway and/or the dirty inlet of the recovery pathway.

The brushroll 50 is positioned in a brush chamber 70, which may be formed by the base housing 64 and the nozzle cover 66, and/or another portion of the base 14. The brushroll 50 is thus positioned within the recovery pathway, and the brush chamber 70 defines a portion of the recovery pathway.

The brushroll 50 can be operably coupled to and driven by a drive assembly 74 including a brushroll motor 72 in the base 14. The coupling between the brushroll 50 and the brushroll motor 72 can comprise one or more belts, gears, shafts, pulleys or combinations thereof. In FIG. 3, a portion of the base 14 is removed so that the motor 72 and drive assembly 74 is visible. Alternatively, the vacuum motor 58 (FIG. 2) can provide both vacuum suction and brushroll rotation.

As shown in FIG. 4, the nozzle cover 66 can be removable from the base housing 64 to access the brushroll 50, which can be removable from the brush chamber 70 for cleaning, drying, and/or replacement. The nozzle cover 66 closes the brush chamber 70 to capture the brushroll 50 therein. Accordingly, the nozzle cover 66 is removed from the base housing 64 prior to removing the brushroll 50. With the cover 66 removed as shown in FIG. 4, the brushroll 50 and brush chamber 70 can be accessed by the user. In other embodiments, the brushroll 50 and chamber 70 can be configured so that prior removal of a nozzle cover is not required, such as by having the brushroll 50 removable through lateral side of the base 14 or from the underside of the base 14.

In some embodiments, the base 14 includes a first duct 73 forming a portion of the conduit 48 between the suction nozzle 54 and the recovery tank 22. The first duct 73 extends through the base housing 64, from a rear side of the suction nozzle, and fluidly couples with a second duct 75. The first duct 73 can be a rigid duct formed at least partially by the base housing 64 and the nozzle cover 66, and/or another portion of the base 14. The nozzle over 66 can, for example, enclose and define a top wall 71 of the first suction duct 73. The nozzle over 66 can be translucent to allow visual inspection of the duct 73 and brushroll 50.

The second duct 75 can extend through the joint assembly 38, e.g. from the base 14 to the body 12 (see FIG. 2), and can be formed by a flexible hose to accommodate the movement of the joint assembly 38. While shown as internal to the joint assembly 38 in the figures, in other embodiments, the second suction duct 75 can extend externally of the joint assembly 38.

The distributor 42 for the delivery system can include one or more spray tips on the base 14, and can be positioned to deliver cleaning fluid to the brushroll 50, thereby indirectly providing cleaning fluid to the floor surface, or can be positioned to deliver cleaning fluid directly to the floor surface. In the embodiment shown, the spray tips 42 are provided on an interior or brush-facing side of the nozzle cover 66. The spray tips 42 can be fed via channels of the cover 66, which terminate in connector ports 76 that couple with spray connectors 78 on the base housing 64 when the cover 66 is installed on the base housing 64. The spray connectors 78, in turn, are supplied with cleaning fluid via the pump 44 (FIG. 2) or other flow control system of the apparatus 10. The spray tips 42 can optionally be oriented to spray fluid inwardly onto the brushroll 50.

Other embodiments of fluid distributors are possible, such as a spray manifold having multiple outlets or a spray nozzle configured to spray cleaning fluid outwardly from the base 14 in front of the surface cleaning apparatus 10.

Figure 5:
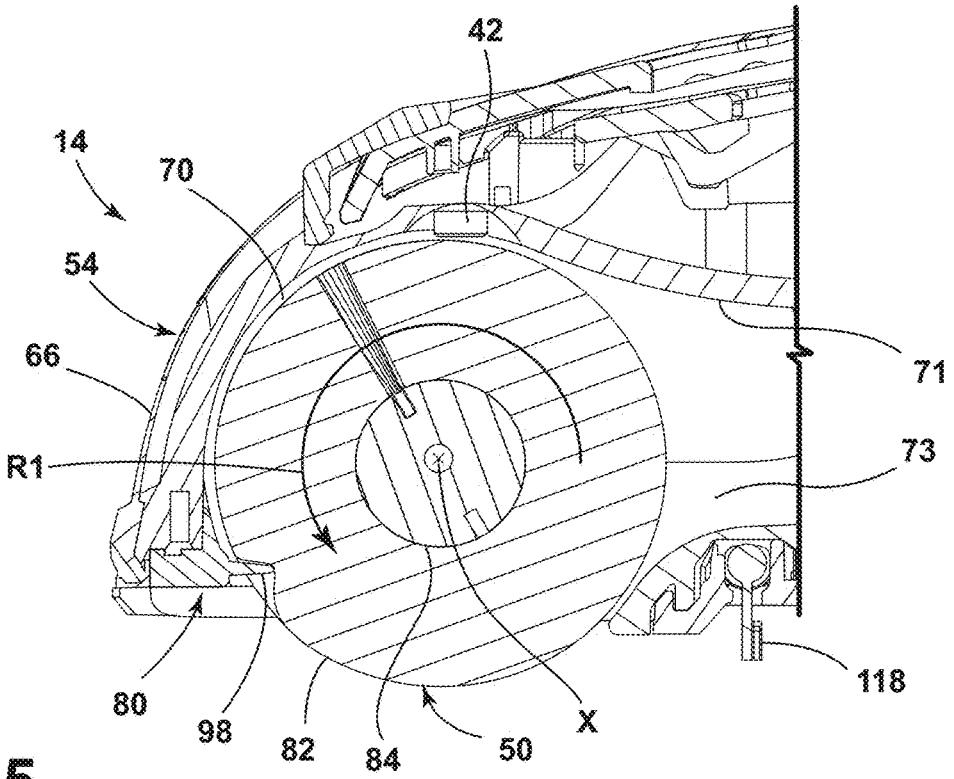
FIG. 5 is a sectional view through line V-V of FIG. 3, showing a forward section of the base including details of a brush chamber and an assembly including a brushroll and an interference wiper.
Figure 6:
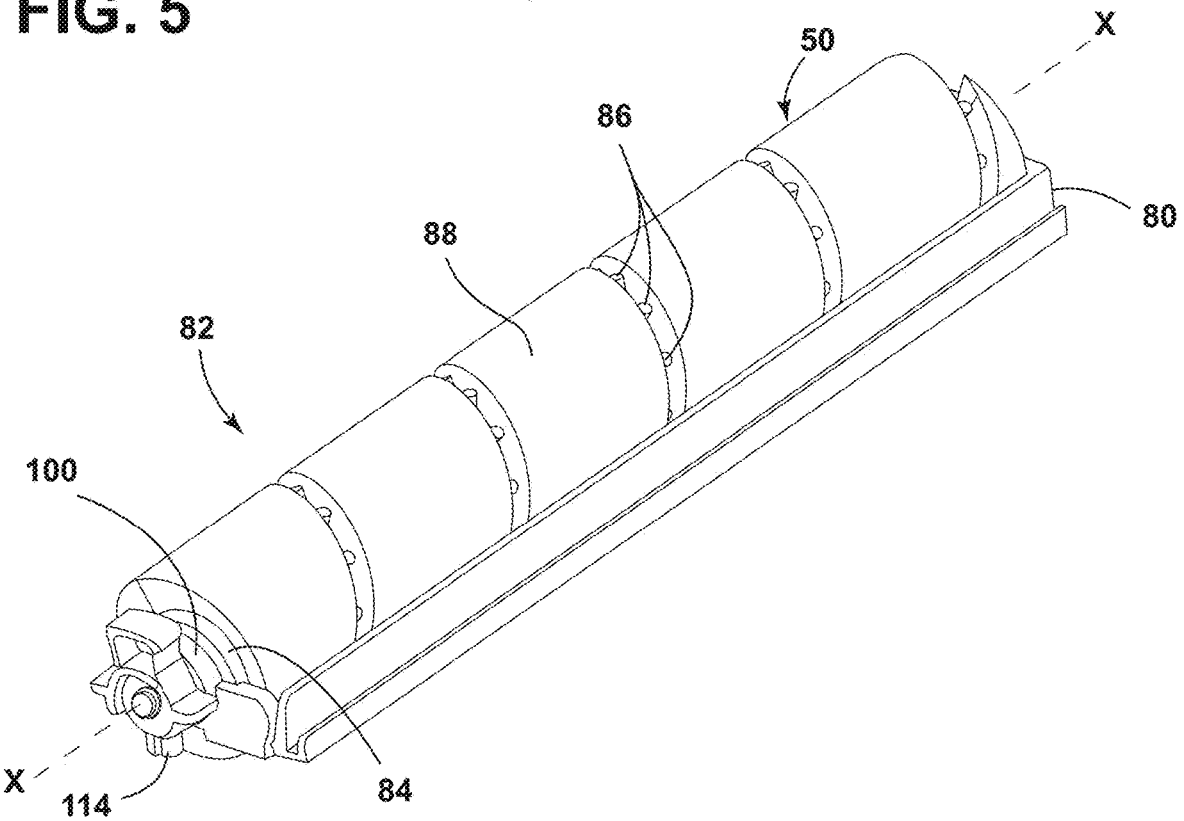
FIG. 6 is a perspective view of the assembly from FIG. 5.

Referring to FIG. 5, the brushroll is positioned in the brush chamber 70 and rotates in a direction R1 about rotational axis X. An interference wiper 80 is integrated with the brushroll 50 and forms an assembly 82, with the assembly 82 being removable from the base housing 64 as a unit, one example of which is shown in FIG. 6. The wiper 80 is configured to interface with a leading portion of the brushroll 50, as defined by the direction of rotation R1 of the brushroll 50. The brush chamber 70 can have a suitable clearance such that only the wiper 80 interfaces with the brushroll 50, e.g. the nozzle cover 66 does not interface with the brushroll 50. The interference wiper 80 is generally below the distributor 42 (FIG. 4), such that the wetted portion brushroll 50 rotates past the interference wiper 80, which scrapes excess liquid off the brushroll 50, before reaching the surface to be cleaned. Other locations for the wiper 80 in relation to the brushroll 50, where the wiper 80 is configured to interface with a portion of the brushroll 50, are possible.

Figure 7:
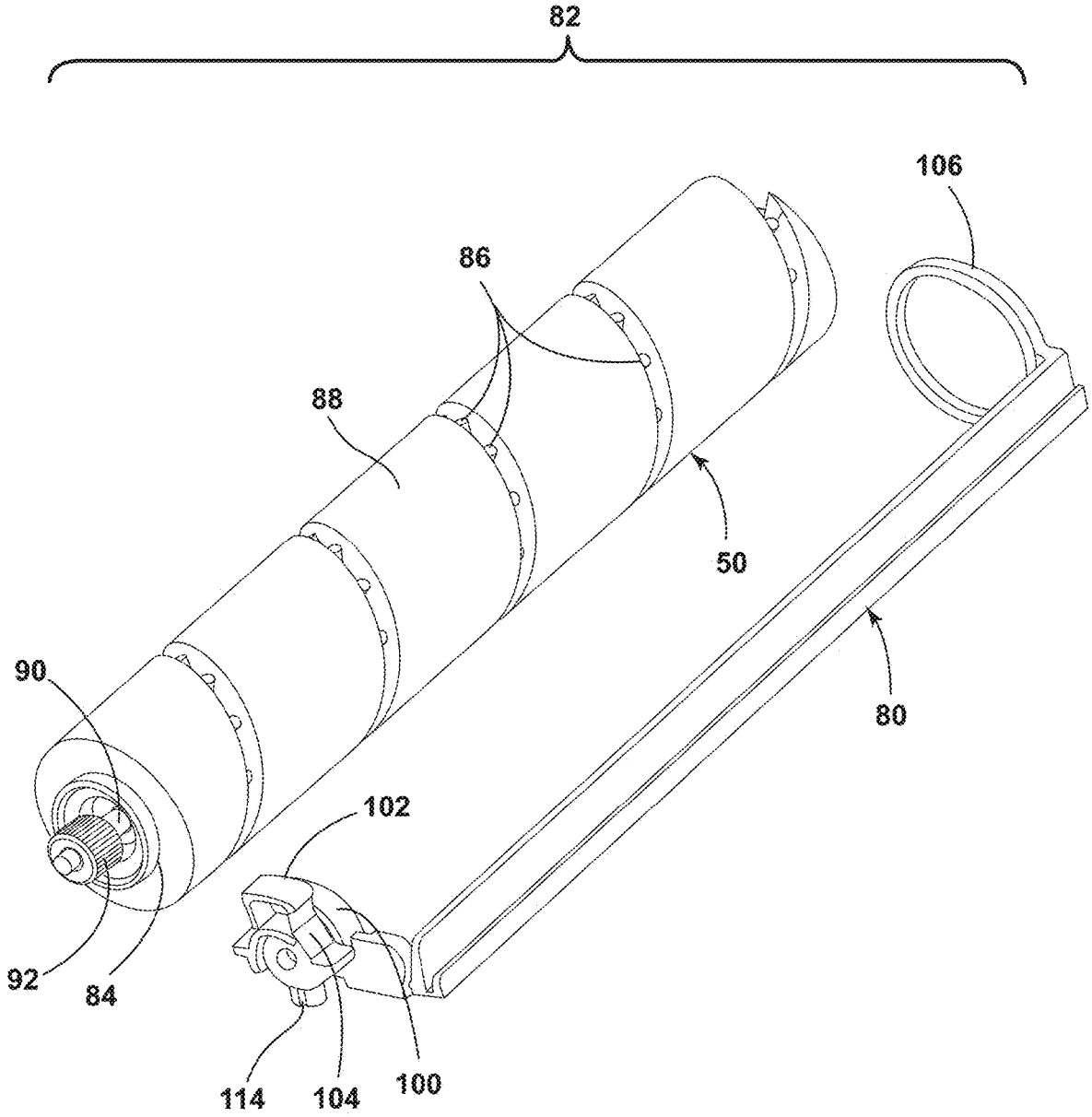
FIG. 7 is an exploded view of the assembly from FIG. 6.

As can be seen in FIGS. 4 and 6, the wiper 80 is integrated with the brushroll 50, such that when the nozzle cover 66 is removed, the wiper 80 remains on the base 14. The entire assembly 82, e.g. the brushroll 50 and wiper 80 is removable as a unit. FIG. 6 depicts the assembly 82 in a removed state. When removed, the brushroll 50 can be separated from the wiper 80, for example as shown in FIG. 7. This permits either the brushroll 50 or the wiper 80 to be replaced individually, rather than having to replace the entire assembly 82 when one component reaches the end of its useful life.

The brushroll 50 can be a hybrid brushroll suitable for use on both hard and soft surfaces, and for wet or dry cleaning. In one embodiment, the brushroll 50 comprises a brush bar 84 supporting at least one agitation element 86, 88. In one embodiment, the agitation element can comprise a plurality of bristles 86 and microfiber material 88 provided on the brush bar 84, with the microfiber material 88 arranged between the bristles 86. Bristles 86 can be tufted or unitary bristle strips and constructed of nylon, or any other suitable synthetic or natural fiber. The microfiber material 88 can be constructed of polyester, polyamides, or a conjugation of materials including polypropylene or any other suitable material known in the art from which to construct microfiber.

To rotatably support the brushroll 50 in the base 14, the brushroll 50 can include an end assembly at a first end of the brush bar 84. The end assembly can, for example, include a stub shaft 90 extending from the first end of the brush bar 84 and a bearing 92 having an inner race press fitted on the stub shaft 90 and an outer race fixed in a portion of the wiper 80, as described in further detail below.

Referring to FIGS. 6-7, the wiper 80 can include an elongated wiper blade 98 having opposing ends. The wiper blade 98 can be disposed at a forward portion of the brush chamber 70 and interfaces with a wetted portion of the rotating brushroll 50 to scrape excess liquid off before reaching the surface to be cleaned. The blade 98 can be positioned to interfere with the at least one agitation element 86, 88 within a forward, lower quadrant of the brushroll 50 (see FIG. 5). Optionally, the wiper blade 98 can project in a rearward direction and generally parallel to the surface to be cleaned.

The wiper blade 98 can be rigid, i.e. stiff, and non-flexible, so the wiper blade 98 does not yield or flex by engagement with the brushroll 50. Optionally, the wiper blade 98 can be formed of rigid thermoplastic material, such as poly (methyl methacrylate) (PMMA), polycarbonate, or acrylonitrile butadiene styrene (ABS). In other embodiments, the wiper blade 98 can be flexible.

The wiper 80 can include an end cap 100 at a first end of the wiper blade 98. The end cap 100 can be integrally formed with or otherwise attached to the wiper blade 98 such that the end cap 100 is removable from the brushroll 50 with the blade 98. To mount the wiper 80 to the brushroll 50, an outer race of the bearing 92 is fixed in the end cap 100.

The wiper 80 can include a handle 102 to aid in removing the assembly 82 from the brush chamber 70. The handle 102 can optionally include indents 104 in the sides of the handle 102 to assist in gripping the handle 102 to lift the assembly 82. The indents 104 can, for example, by pinched between the thumb and forefinger of the user.

In the embodiment shown, the handle 102 can be integrally formed with or otherwise attached to the end cap 100, and can project upwardly from the end cap 100 when the assembly 82 is seated in the brush chamber 70 (see FIG. 4) so that a user can grip the handle 102 to lift the assembly 82 up.

Figure 8:
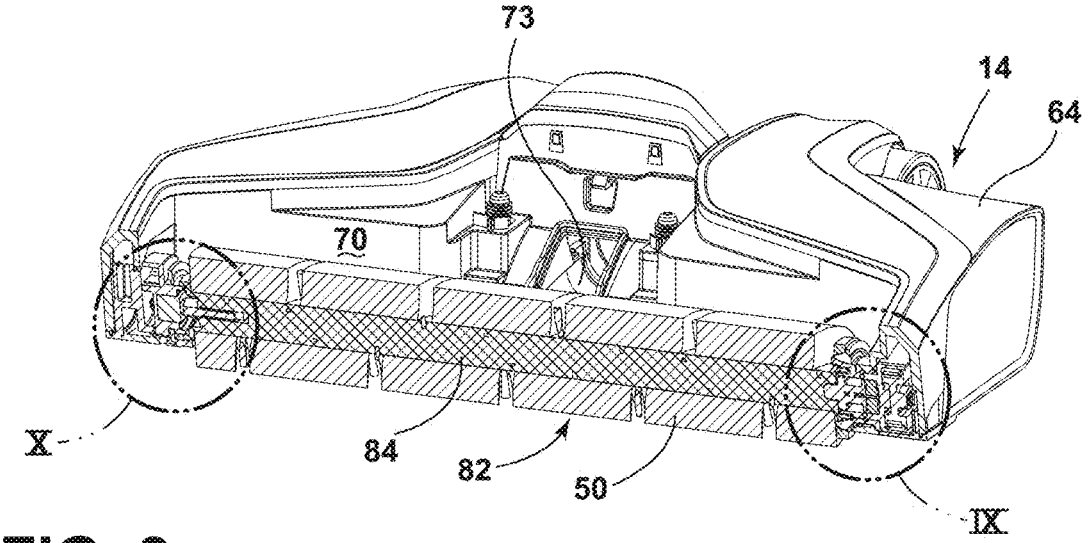
FIG. 8 is a sectional view through line VIII-VIII of FIG. 3, with the nozzle cover removed to show internal details of the brushroll.
Figure 9:
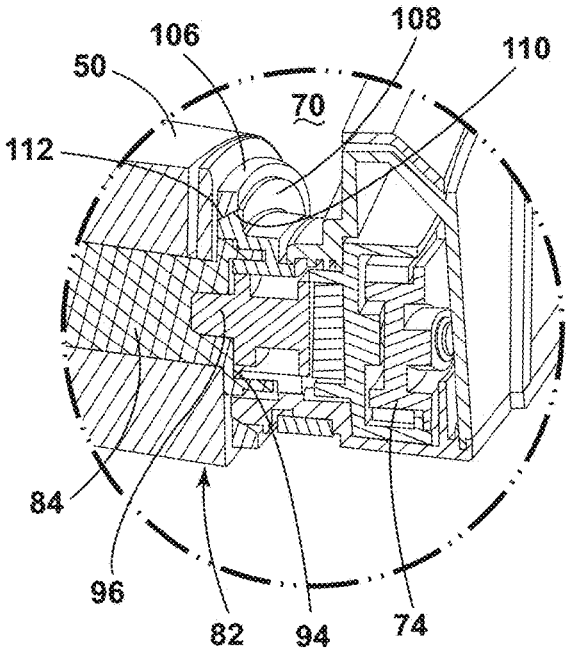
FIG. 9 is an enlarged view of section IX of FIG. 8.

Referring to FIGS. 8-9, the brushroll 50 can include a drive end cap 94 at a second end of the brush bar 84 that couples with a drive head 96 of the drive assembly 74. The drive end cap 94 and the brush bar 84 are formed or joined together such that upon drive input to the end cap 94, the brush bar 84 rotates. In one embodiment, the drive end cap 94 can have a splined drive connection with the drive head 96. Other drive connections between the brushroll 50 and drive assembly 74 are possible.

To accommodate the drive coupling between the driven end of the brushroll 50 and drive assembly 74, the wiper 80 can include a cap ring 106 at a second end of the wiper blade 98 (see FIG. 7). The cap ring 106 can be integrally formed with or otherwise attached to the wiper blade 98 such that the cap ring 106 is removable from the brushroll 50 with the blade 98. The cap ring 106 can have a larger inner diameter than an outer diameter of the drive end cap 94.

To support the second end of the wiper 80, the cap ring 106 is fitted over a hub 108 of the drive assembly 74. The hub 108 can surround the drive head 96, with clearance therebetween for the drive head 96 to spin within the stationary hub 108 when motive force is applied by the brushroll motor 72.

The cap ring 106 can be chamfered for easy lead-in when installing the assembly 82 in the brush chamber 70. The hub 108 can have an outer edge 110 that is beveled or chamfered and the cap ring 106 can have an inner edge 112 with a complementary bevel or chamfer, which allows for easy insertion of the hub 108 into the cap ring 106 and aids in centering the assembly 82 when coupling the drive end cap 94 with the drive head 96. The chamfered inner edge 112 also exposes more of the drive end cap 94 for easier coupling with the drive head 96.

Figure 10:
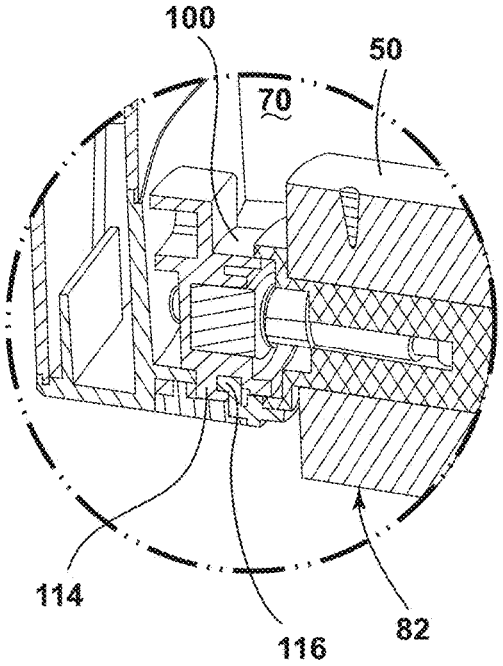
FIG. 10 is an enlarged view of section X of FIG. 8.

Referring to FIGS. 8 and 10, the assembly 82 can be secured in the brush chamber 70 by a latch. Various configurations for the latch are possible. In the illustrated embodiment, a portion of the latch is provided on the end cap 100, with a mating portion provided in the brush chamber 70. Particularly, the end cap 100 can have a latch member 114 that is snap-fit within a latch receiver 116 in the brush chamber 70.

Referring to FIG. 5, in some embodiments, a squeegee 118 can be mounted to the base housing 64 behind the brushroll 50 and the brush chamber 70 and is configured to contact the surface as the base 14 moves across the surface to be cleaned. The squeegee 118 wipes residual liquid from the surface to be cleaned so that it can be drawn into the recovery pathway via the suction nozzle 54, thereby leaving a moisture and streak-free finish on the surface to be cleaned. Optionally, the squeegee 118 can be disposed generally orthogonal to the surface to be cleaned, or vertically. The squeegee 118 can be smooth as shown, or optionally comprise nubs on the end thereof. In other embodiments, the squeegee 118 is not provided in addition to the wiper 80.

The squeegee 118, if present, can be pliant, i.e. flexible or resilient, in order to bend readily according to the contour of the surface to be cleaned yet remain undeformed by normal use of the apparatus 10. Optionally, the squeegee 118 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the apparatus 10.

Figure 11:
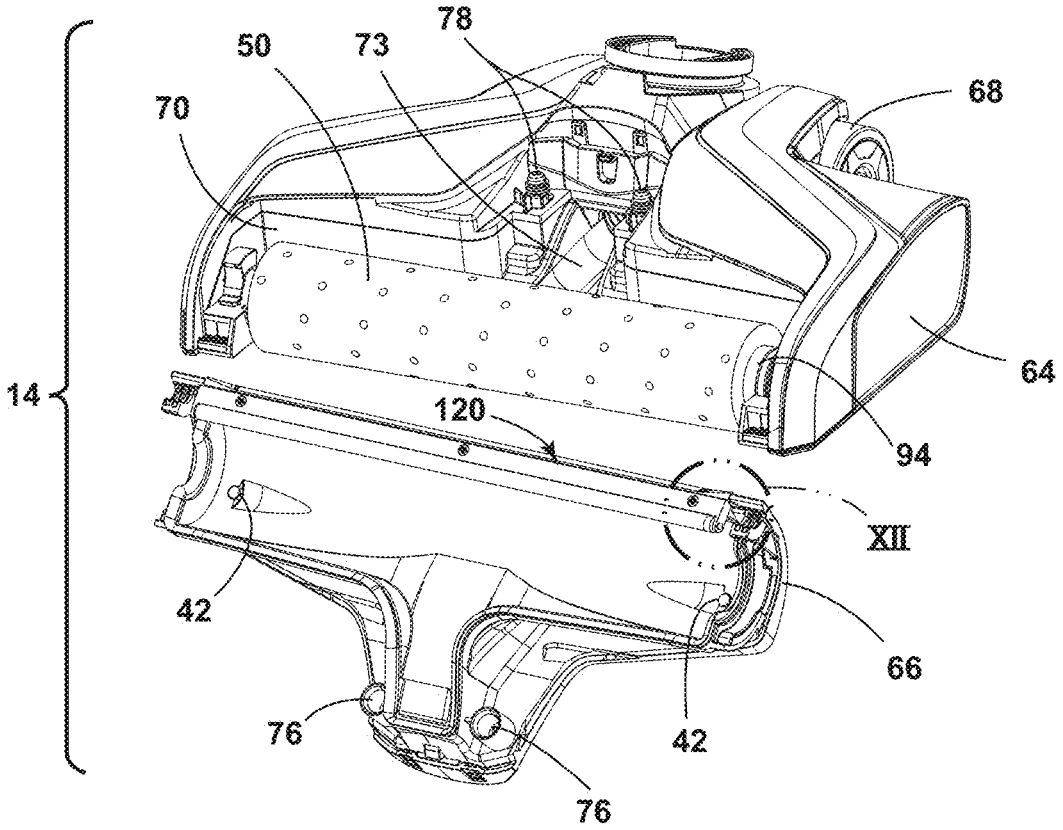
FIG. 11 is a perspective view of a base for a surface cleaning apparatus according to an aspect of the disclosure, showing a nozzle cover removed from a base housing and an inference roller assembly on the nozzle cover.

FIGS. 11-15 show another embodiment of an interference wiper for the brushroll 50. In the second embodiment, the interference wiper comprises a roller 120 integrated with the nozzle cover 66 and forms a removable assembly 122, such that when the nozzle cover 66 is removed, the roller 120 is also removed. The entire assembly 122, e.g. the cover 66 and roller 120 is removable as a unit. FIG. 11 depicts the assembly 122 in a removed state.

Figure 12:
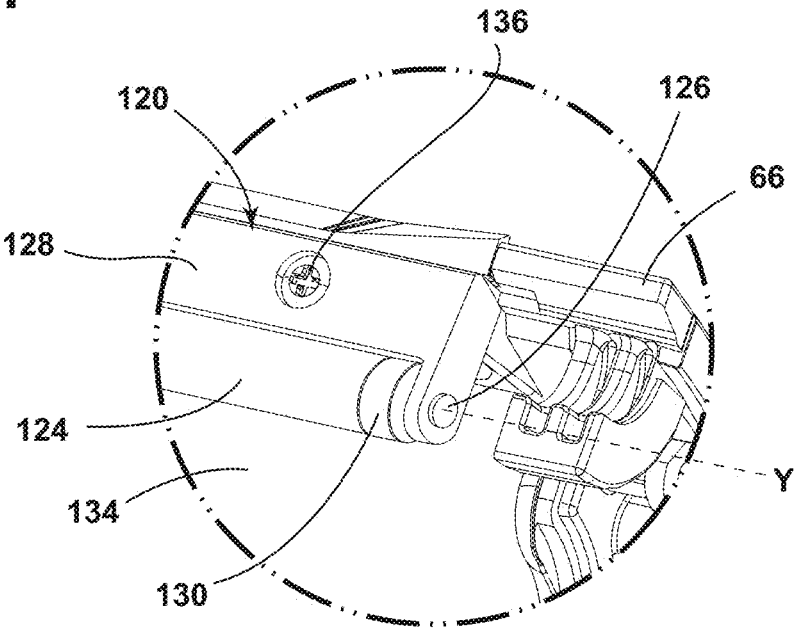
FIG. 12 is an enlarged view of section XII of FIG. 11.
Figure 13:
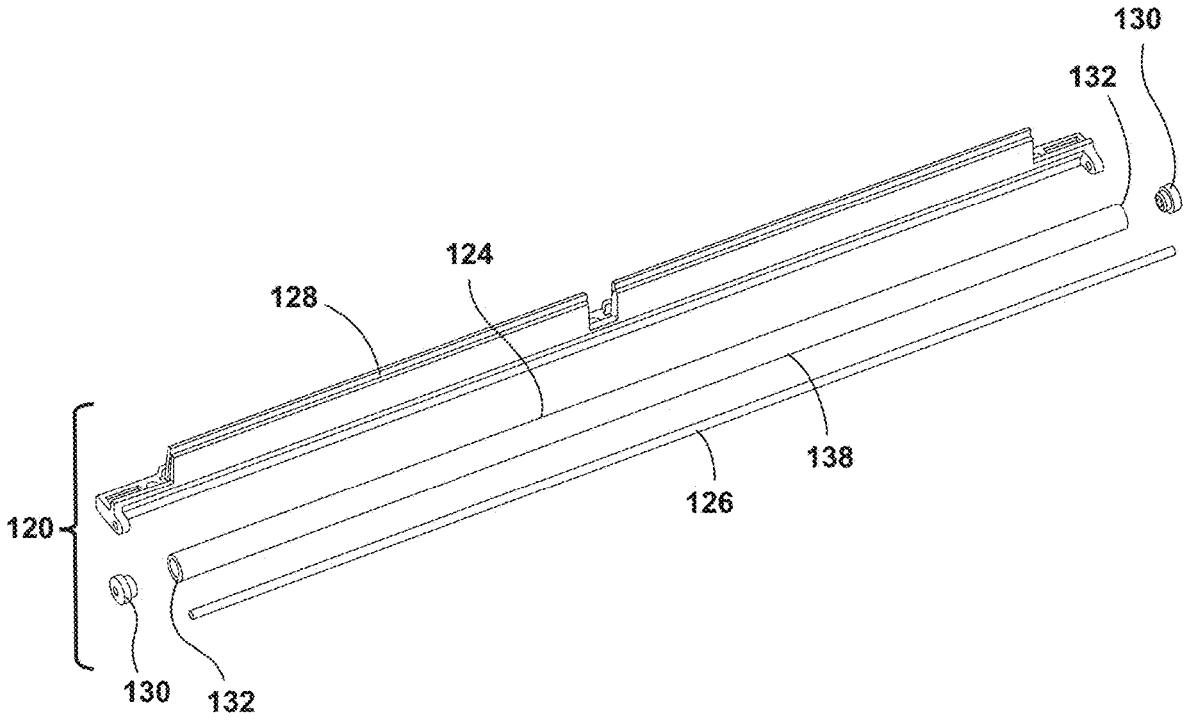
FIG. 13 is an exploded view of the inference roller assembly from FIG. 11.

Referring to FIG. 12-13, the roller 120 can include at least one rolling element 124 mounted for free rotation around an axis Y. Various configurations for free rotation of the rolling element 124 are possible. In one embodiment, the axis Y can be defined by a shaft 126 extending through the rolling element 124. The shaft 126 is fixed at opposing ends thereof to a roller mount 128. A bearing 130 is disposed at each opposing end of the shaft 126, and have an inner race press fitted on the shaft 126 and an outer race fixed in an open end 132 of the rolling element 124.

The roller mount 128 is coupled to the nozzle cover 66, and can be integrally formed with or otherwise attached to an inner, or brushroll-facing, side 134 of the nozzle cover 66 to position the rolling element 124 in a suitable location for interference with the brushroll 50. In the embodiment shown, the roller mount 128 is a separately-formed piece that is secured to the nozzle cover 66 with screws 136. Other attachments for the roller mount 128 are possible.

In the present embodiment, the rolling element 124 is elongated and comprises a cylindrical outer surface 138 extending between the open ends 132. A single, elongated rolling element 124 minimizes opportunities for liquid and/or air leaks. The rolling element 124 may be a molded component made from any polymer with sufficient strength and resistance to chemical corrosion. Wood and metal are also suitable alternatives in some embodiments. The surface finish of the rolling element 124 may be smooth or textured. A smoother surface may be preferred, as it will stay cleaner and create less drag friction on the rolling element 124.

Figure 14:
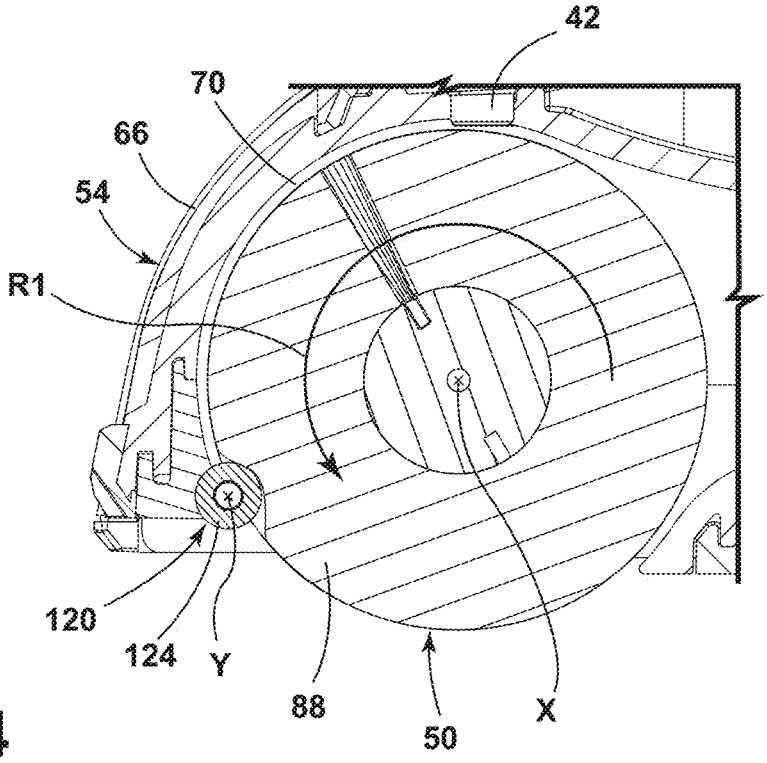
FIG. 14 is a sectional view through the base of FIG. 11, showing a forward section of the base including details of a brush chamber, brushroll, and the inference roller integrated with the nozzle cover.

Referring to FIG. 14, the at least one rolling element 124 is configured to interface with a leading portion of the brushroll 50, as defined by the direction of rotation R1 of the brushroll 50. The rolling element 124 can be disposed at a forward portion of the brush chamber 70 and interfaces with a wetted portion of the rotating brushroll 50 to compresses the brushroll 50 while substantially blocking air and water leakage at the forward side of the brush chamber 70. The brush chamber 70 can have a suitable clearance such that only the rolling element 124 interfaces with the brushroll 50, e.g. the nozzle cover 66 does not interface with the brushroll 50. The rolling element 124 is generally below the distributor 42, such that the wetted portion brushroll 50 rotates past the rolling element 124, which compresses the microfiber 88 (or other agitation material) of the brushroll 50, and forces excess liquid out of the microfiber 88 before reaching the surface to be cleaned. Other locations for the rolling element 124 in relation to the brushroll 50, where the rolling element 124 is configured to interface with a portion of the brushroll 50, are possible.

With the rolling element 124 mounted for free rotation, the rotating brushroll 50 can transfer force to the rolling element 124 via friction, resulting in the rolling element 124 rotating in a direction R2 about its rotational axis Y, with R2 being opposite the brushroll rotation direction R1. The rotational axis Y of the rolling element 124 is preferably parallel to the rotational axis X of the brushroll 50.

Figure 15:
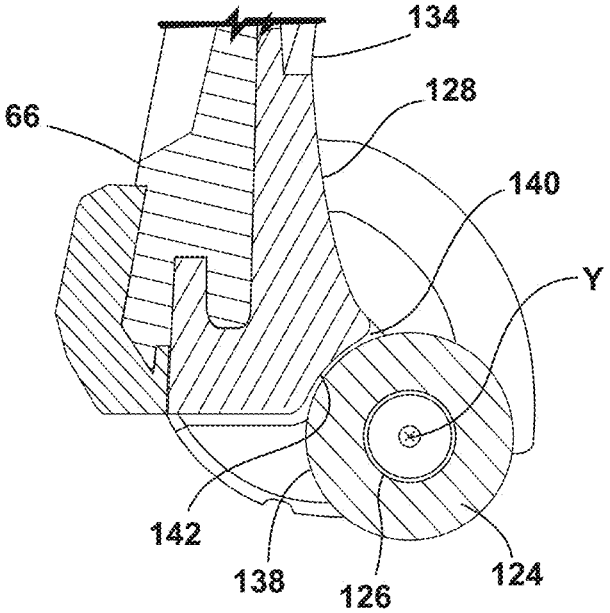
FIG. 15 is an enlarged view of the inference roller integrated with the nozzle cover of FIG. 14.

Referring to FIG. 15, a gap 140 between the rolling element 124 and the roller mount 128 provides clearance for the rolling element 124 to freely rotate, e.g. by the action of the rotating brushroll 50 against the rolling element 124 as shown in FIG. 14. The roller mount 128 can have a curved roller-facing surface 142 that closely follows the cylindrical outer surface 138 of the rolling element 124, with the gap 140 being defined between the surfaces 138, 142. The gap 140 and rolling motion of the rolling element 124 reduces the torque load on the drive motor 72 of the brushroll 50. Preferably, the gap 140 is small to minimize air or water leaks. For the embodiment of the assembly 122 shown herein, the gap 140 may be on the order of 0.28 mm.

Figure 16:
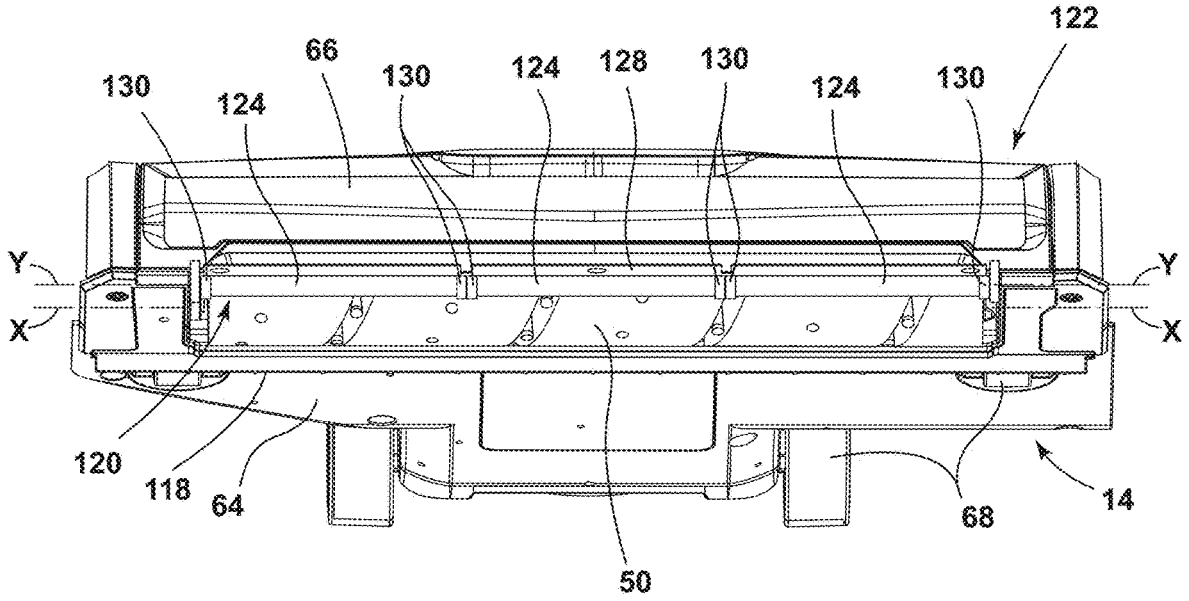
FIG. 16 is a front lower perspective view of a base for a surface cleaning apparatus according to an aspect of the disclosure, showing an inference roller assembly on the nozzle cover having multiple rollers.

FIG. 16 shows a third embodiment of an interference wiper for the brushroll 50. The third embodiment is substantially similar to the roller embodiment of FIGS. 11-15, save for the roller 120 comprising multiple rolling elements 124. The multiple, shorter rolling elements 124 may be less likely to bend and deflect due to the pressure force of being in contact (i.e. interfering with) the brushroll 50. Each rolling element 124 may be mounted for individual free rotation around axis Y. Bearings 130 are fixed in the ends of each rolling element 124, and may be press fitted on individual shafts (not shown). The roller mount 128 is accordingly configured to fix multiple shafts in place.

Figure 17:
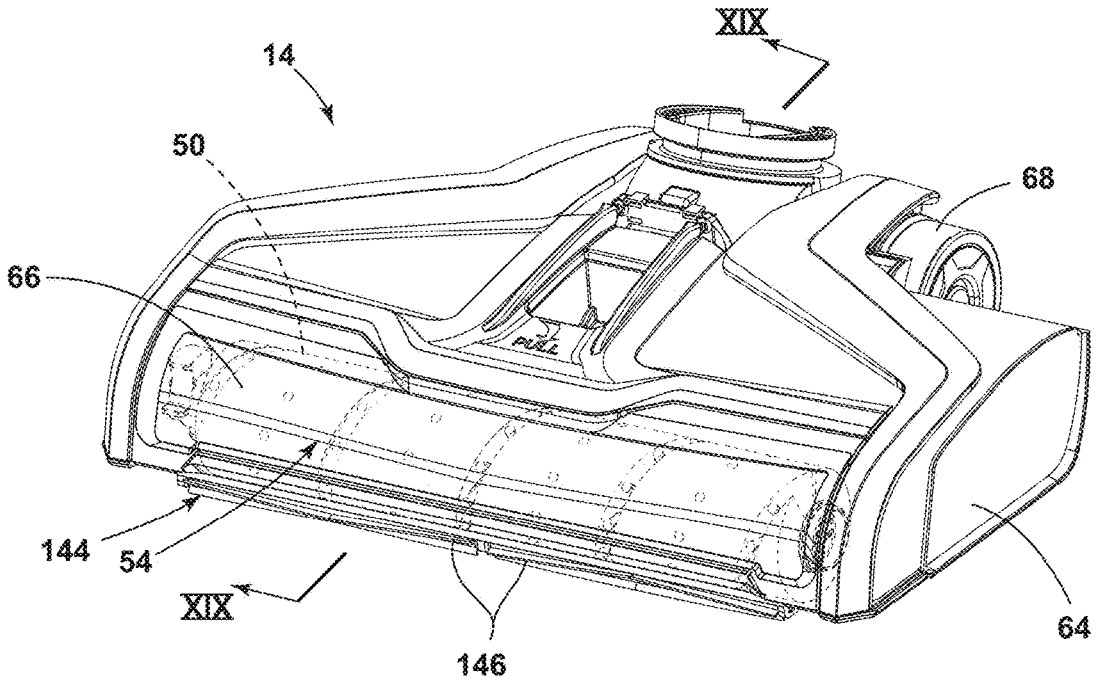
FIG. 17 is a perspective view of a base for a surface cleaning apparatus according to an aspect of the disclosure, showing a rolling squeegee.
Figure 18:
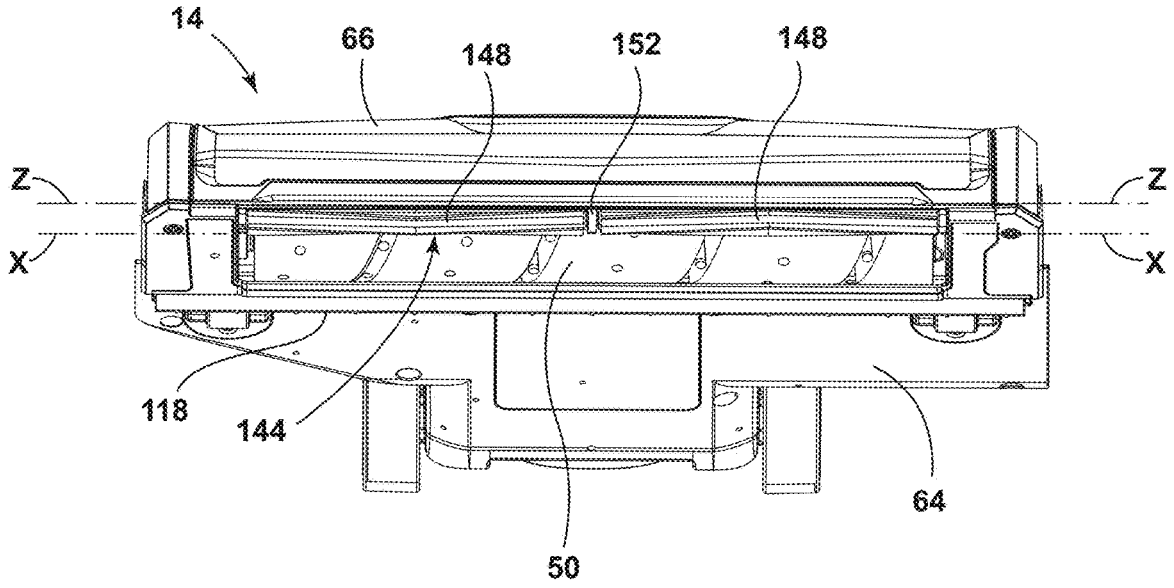
FIG. 18 is a front lower perspective view of the base from FIG. 18.
Figure 19:
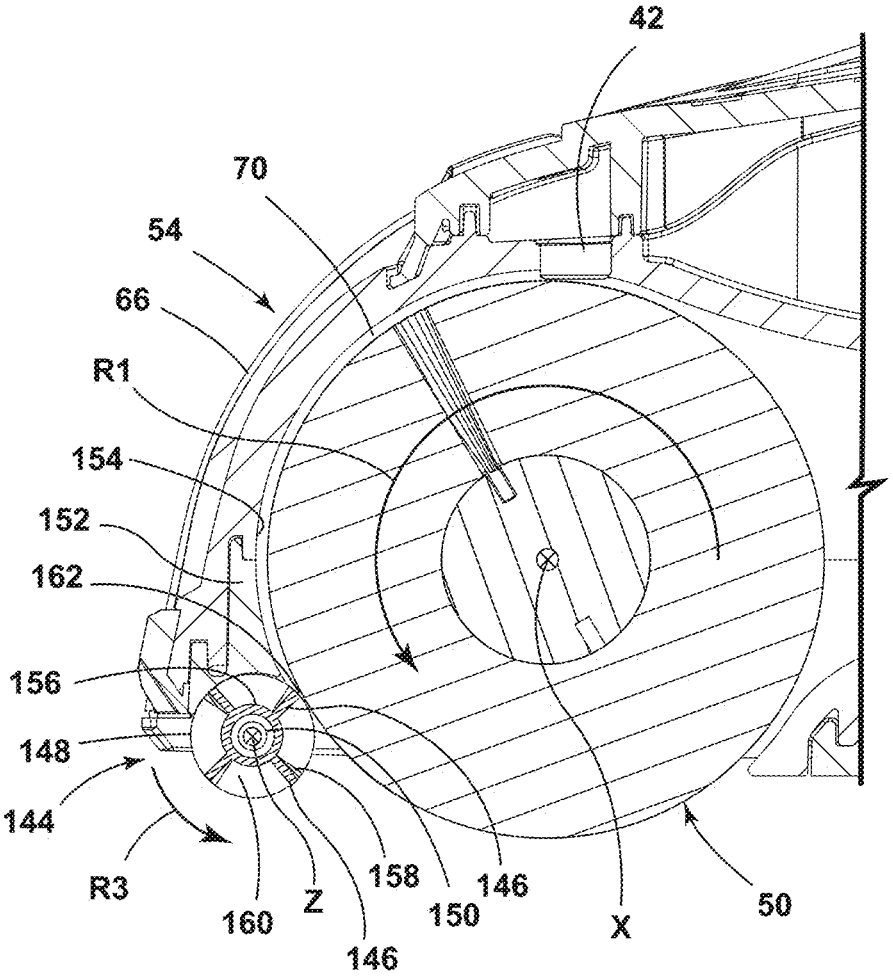
FIG. 19 is a sectional view through line XIX-XIX of FIG. 17, showing a forward section of the base including details of a brush chamber, brushroll, and the rolling squeegee integrated with the nozzle cover.

FIGS. 17-19 show another embodiment of a base 14 for the apparatus 10. In this embodiment, the base 14 includes a rolling squeegee 144 that comprises a plurality of vanes 146. The rolling squeegee 144 does not contact the brushroll 50, and instead is configured to provide a suction seal between the suction nozzle 54 and the floor surface, while allowing large debris to enter the suction nozzle 54, on a forward stroke of the base 14, and wipes the floor to prevent water puddles on a backward stroke of the base 14, as described in further detail below.

The rolling squeegee 144 can include at least one rolling element 148 mounted for unidirectional rotation around an axis Z, the rolling element 148 comprising the multiple vanes 146 extending radially, or substantially radially, relative to the axis Z. In one embodiment, the axis Z can be defined by a shaft 150 extending through the rolling element 148. The shaft 150 is fixed at opposing ends thereof to a squeegee mount 152.

In the embodiment shown, the rolling squeegee 144 includes multiple rolling elements 148. Each rolling element 148 may be mounted for individual unidrectional rotation around axis Z. The roller mount 152 is accordingly configured to fix multiple shafts 150 in place. In other embodiments, a single rolling element 148 may be provided (see, for example, FIGS. 20-21) or more than two rolling elements 148 may be provided.

Various configurations for unidirectional rotation of the rolling element 148 are possible. In one embodiment, one-way rotational bearings (not shown) can be fixed in the ends of each rolling element 148, and may be press fitted on the shafts 150.

Regardless of the configuration of the unidirectional rotation, the roller mount 152 can be coupled to the nozzle cover 66, and can be integrally formed with or otherwise attached to an inner, or brushroll-facing, side 154 of the nozzle cover 66 to position the rolling element 148 in front of the brushroll 50. In the embodiment shown, the roller mount 152 is a separately-formed piece that is secured to the nozzle cover 66. Other attachments for the roller mount 152 are possible.

The vanes 146 can be pliant, i.e. flexible or resilient, such that the vanes 146 can bend readily according to the contour of the surface to be cleaned yet remain undeformed by normal use of the apparatus 10. Optionally, the vanes 146 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the apparatus 10.

In the present embodiment, the rolling elements 148 are elongated and comprise a cylindrical inner body 156, with the plurality of vanes 146 extending from the inner body 156. The vanes 146 an extend radially, or substantially radially, to outer tips 158, and the tips 158 can be angled or can curve about the axis Z so that at least a portion of one vane 146 is always in contact with the floor surface. The vanes 146 can be spaced from each other about the periphery of the inner body 156 to define debris gaps 160 between adjacent vanes 146. The rolling element 148 can be a molded component, and the vanes 146 can be integrally molded with the inner body 156.

Depending on the area to be cleaned, it is commonplace to make multiple, alternating forward and backward strokes of the base 14 during a cleaning operation. For a forward stroke, the base 14 is moved in a forward direction F over the floor surface S, for example via a user gripping the handle 16 (FIG. 1) and pushing the entire apparatus 10 forward. For a backward stroke, the base 14 is moved in a rearward direction B over the floor surface S, for example via a user gripping the handle 16 and pulling the entire apparatus 10 backward.

With the rolling elements 148 mounted for unidirectional rotation, the rolling elements 148 rotate in a direction R3 about axis Z on a forward stroke of the base 14 due to contact between the vanes 146 and the floor surface, with direction R3 being the same as the brushroll rotation direction R1. The rotational axis Z of the rolling elements 148 is preferably parallel to the rotational axis X of the brushroll 50.

On the forward stroke, the rolling elements 148 can roll over larger debris while maintaining a tight seal between the suction nozzle 54 and the floor surface. This prevents "plowing" of larger debris while maintaining maximum suction that is effective to remove small, fine debris from the surface in addition to the larger debris.

On a backward stroke, the rolling elements 148 stop rotating and the vanes 146 remain in a fixed orientation. Due to the design of the vanes 146, at least a portion of at least one vane 146 is in contact with the floor surface at any orientation in which the rolling elements 148 stop. The vane or vanes 146 in contact with the floor surface on the backward stroke squeegees or wipes residual liquid from the surface to be cleaned so that it can be drawn into the recovery pathway via the suction nozzle 54, thereby leaving a moisture and streak-free finish on the surface to be cleaned.

Referring to FIG. 18, in the embodiment shown, the rolling squeegee 144 is provided in addition to the squeegee 118, with the squeegee 118 mounted to the base housing 64 behind the rolling squeegee 144, the brushroll 50, and the brush chamber 70. The squeegee 118 does not roll, but may flex back and forth on the forward and backward cleaning strokes. In other embodiments, a second squeegee 118 is not provided in addition to the rolling squeegee 144.

Referring to FIG. 19, the rolling element 148 is disposed generally in front of and, optionally slightly below, the brushroll 50. Other locations for the rolling element 148 in relation to the brushroll 50, where the rolling element 148 does not interface with the brushroll 50, are possible. There is an air gap 162 between the rolling element 148 and the rotating brushroll 50. Preferably, the air gap 162 is small to minimize water leaks. For the embodiment shown, the air gap 162 may be on the order of 0.5 mm-1.0 mm.

As can be seen in FIG. 19, the rolling squeegee 144 is integrated with the nozzle cover 66, such that when the nozzle cover 66 is removed, the rolling squeegee 144 is also removed. The squeegee 144 and cover 66 can forms a removable assembly, with the assembly being removable from the base housing 64 as a unit.

Figure 20A:
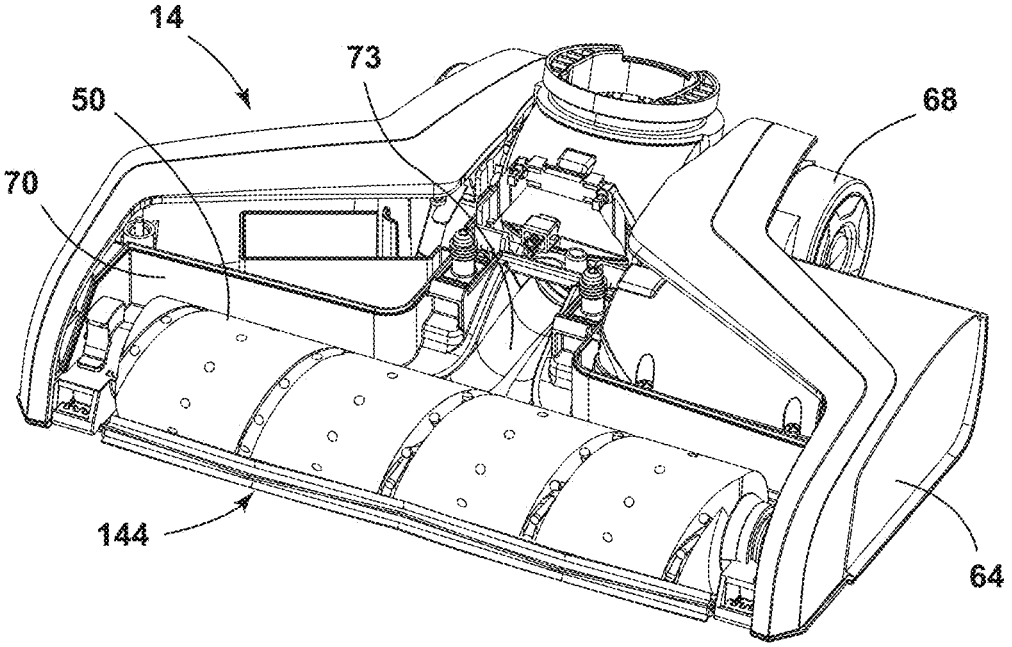
FIG. 20A is a perspective view of a base for a surface cleaning apparatus according to an aspect of the disclosure, with a nozzle cover hidden to show a rolling squeegee integrated with a brushroll.
Figure 20B:
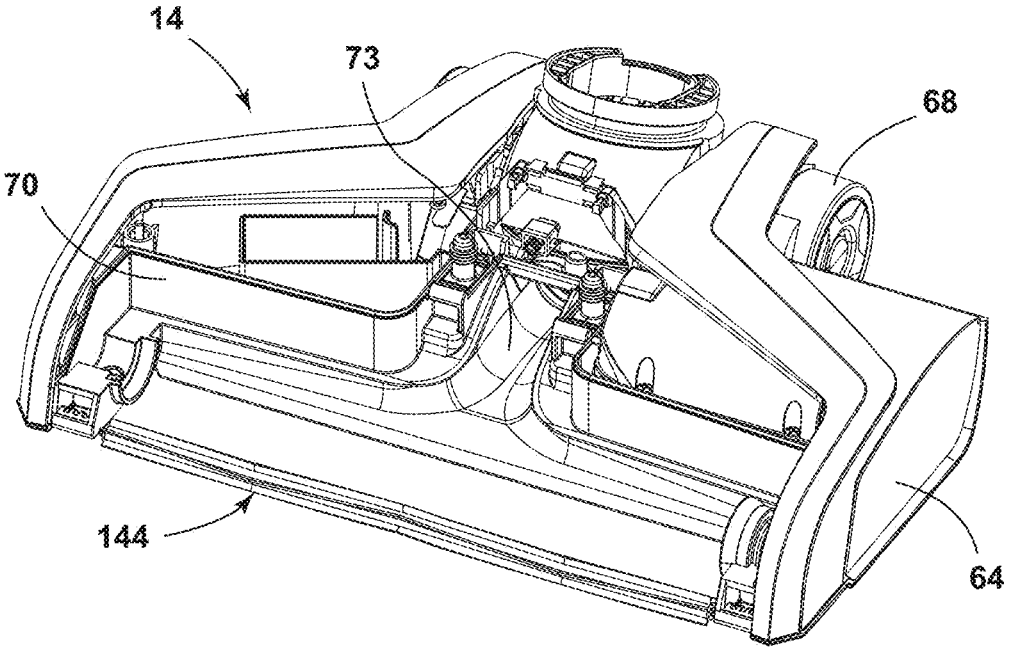
FIG. 20B is a perspective view of a base for a surface cleaning apparatus according to an aspect of the disclosure, with a nozzle cover and brushroll hidden to show a rolling squeegee integrated with a base housing.

Other mounting arrangements for the squeegee 144 are possible. FIG. 20A shows an embodiment where the rolling squeegee 144 is integrated with the brushroll 50, such that when the nozzle cover 66 is removed, the rolling squeegee 144 remains on the base housing 64. FIG. 20B shows an embodiment where the rolling squeegee 144 is integrated with the base housing 64, such that when the nozzle cover 66 and the brushroll 50 are removed, the rolling squeegee 144 remains on the base housing 64.

Figure 21A:
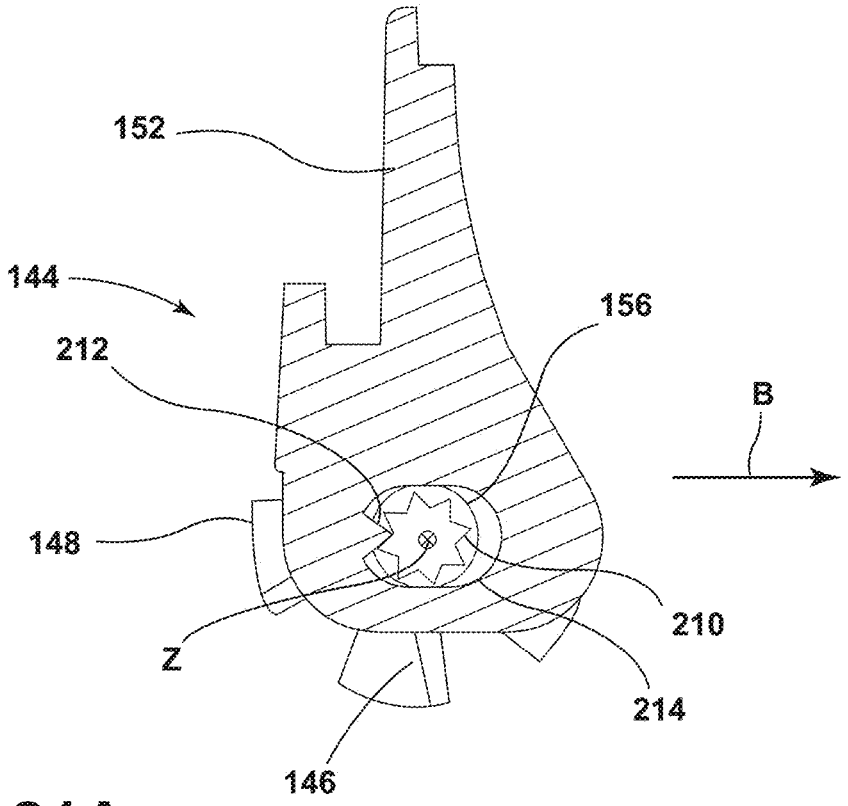
FIG. 21A is a sectional view of a rolling squeegee according to an aspect of the disclosure, showing the rolling squeegee on a backward stroke of the base.
Figure 21B:
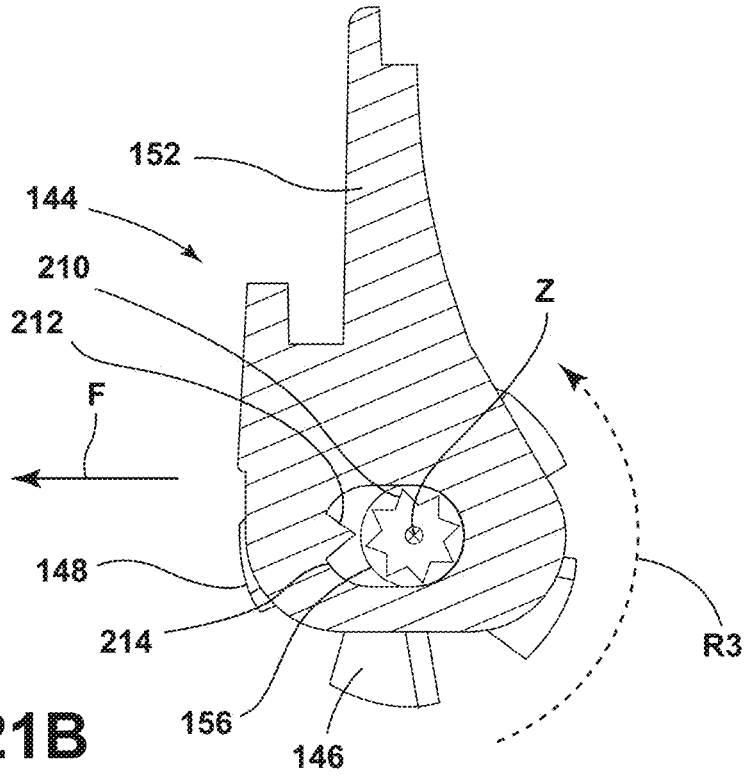
FIG. 21B is a view similar to FIG. 21A, showing the rolling squeegee on a forward stroke of the base.
Figure 22:
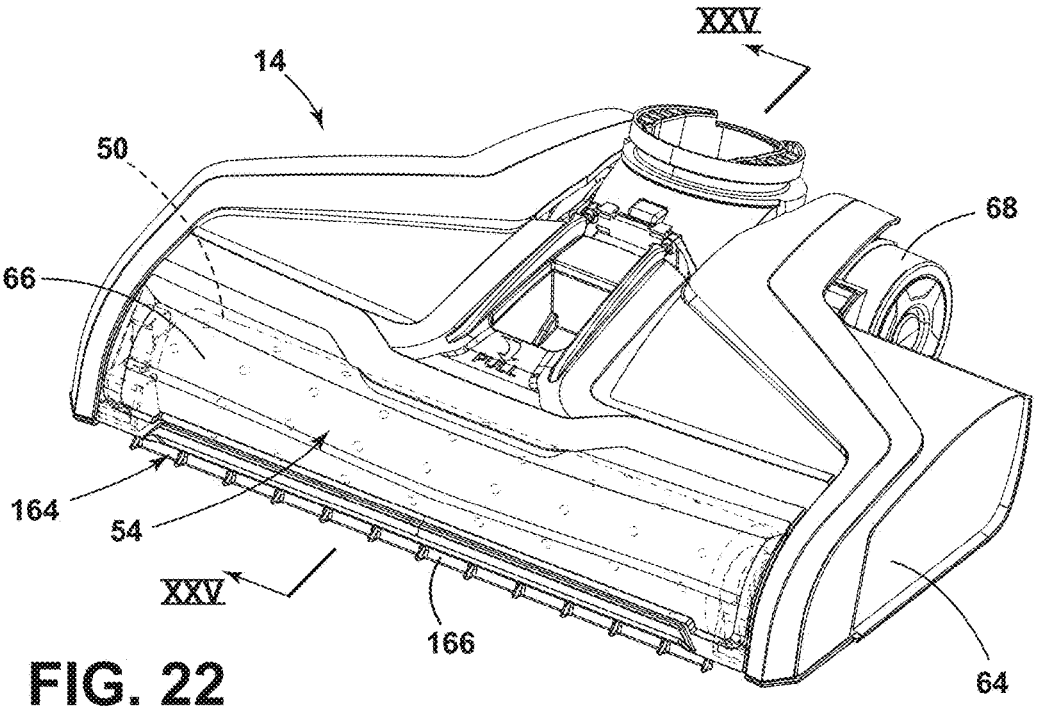
FIG. 22 is a perspective view of a base for a surface cleaning apparatus according to an aspect of the disclosure, showing a cantilevered squeegee.

FIGS. 21A-21B show another embodiment of the rolling squeegee 144 with at least one rolling element 148 mounted for unidirectional rotation around axis Z. In this embodiment, the rolling element 148 has a locking gear 210 that makes contact with a locking tooth 212 when the apparatus 10 is moved in a backward stroke to prevent rotation of the rolling element 148 about the axis Z.

The locking gear 210 can be provided on at least one, and optionally on each, end of the cylindrical inner body 156, with a corresponding tooth 212 provided in a suitable location to engage the locking gear 210.

The tooth 212 can be disposed within a slot 214 on the squeegee mount 152 that receives the portion of the body 156, or other portion of the rolling element 148, that includes the locking gear 210. The slot 214 can be elongated, including being oval- or racetrack-shaped as shown, such that the rolling element 148 can translate linearly, e.g. move forward or backward, within the slot 214 to move the locking gear 210 into and out of engagement with the tooth 212.

On a backward stroke, indicated by arrow B in FIG. 21A, friction between the vanes 146 and the floor surface pulls the rolling element 148 forward within the slot 214, thereby bringing the locking gear 210 into engagement with the tooth 212. The rolling element 148 is prevented from rotating and the vanes 146 remain in a fixed orientation.

On the forward stroke, indicated by arrow F in FIG. 21B, friction between the vanes 146 and the floor surface pulls the rolling element 148 backward in the slot 214, thereby disengaging the locking gear 210 from the tooth 212. The rolling element 148 is free to rotate in direction R3 about axis Z, as shown in FIG. 21A.

FIGS. 22-26 show yet another embodiment of a base 14 for the apparatus 10. In this embodiment, the base 14 includes a cantilevered squeegee assembly 164 that can include at least one squeegee 166 having a first end 168 that is fixed or mounted and a second end 170 that is free to bend or flex about a flexion point P. The cantilevered squeegee assembly 164 does not contact the brushroll 50, and instead is configured to lift up on a forward stroke of the base 14 to allow large debris to enter the suction nozzle 54, and wipes the floor to prevent water puddles on a backward stroke of the base 14, as described in further detail below.

The mounted end 168 of the squeegee 166 can be fixed to a squeegee mount 172. The squeegee mount 172 is coupled to the nozzle cover 66, and can be integrally formed with or otherwise attached to an inner, or brushroll-facing, side 174 of the nozzle cover 66 to position the squeegee 166 in a suitable location forward of the brushroll 50. In the embodiment shown, the squeegee mount 172 is a separately-formed piece that is secured to the nozzle cover 66 with one or more screws 176. Other attachments for the squeegee mount 172 are possible. In other embodiments, the assembly 164 may be integrated with the brushroll 50 rather than the nozzle cover 66, or may be integrated with the base housing 64 rather than either the brushroll 50 or the nozzle cover 66.

The free end 170 of the squeegee 166 can include a leading side 178 and an opposing trailing side 180, with the sides 178, 180 meeting and terminating at a wiper edge 182. A plurality of protrusions 184 are disposed on the leading side 178 and are spaced apart to define debris gaps 186 between adjacent protrusions 184. The protrusions 184 can project orthogonally from the leading side 178 and have a shape configured to catch on the floor surface on a forward stroke of the base 14 and to release from the floor surface on a backward stroke of the base 14.

The squeegee 166 can be pliant, i.e. flexible or resilient, in order to bend readily on the cleaning strokes, yet remain undeformed by normal use of the apparatus 10. Optionally, the squeegee 166 can be formed of a rubber silicone material, and may have a hardness of 70-90 Shore A.

Figure 25:
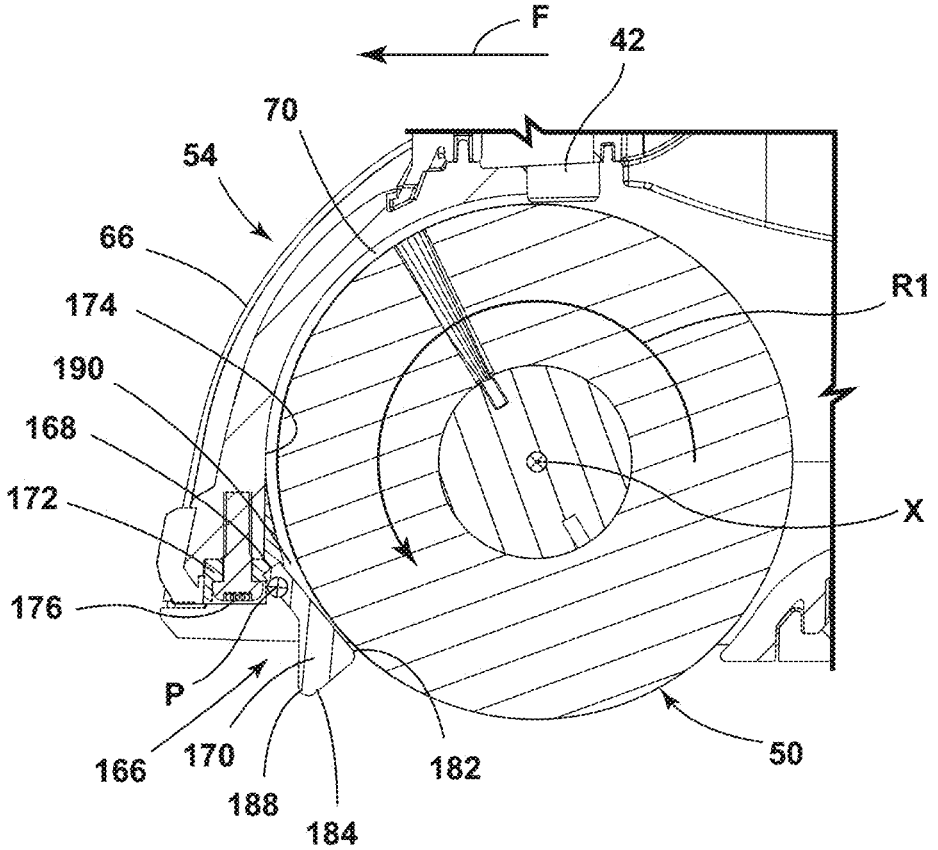
FIG. 25 is a sectional view through line XXV-XXV of FIG. 22, showing a forward section of the base including details of a brush chamber, brushroll, and the cantilevered squeegee on a forward stroke of the base.

Referring to FIG. 25, on the forward stroke, the protrusions 184 catch on the floor surface and the squeegee 166 bends at flexion point P. This lifts the wiper edge 182 up, and allows large debris to enter the suction nozzle 54 through the debris gaps 186 between adjacent protrusions 184. In the embodiment shown, the protrusions 184 can comprise triangular ribs having tips 188 that dig against the floor surface on a forward stroke of the base 14, thereby bending the free end 170 of the squeegee 166 backward to lift the wiper edge 182.

Figure 26:
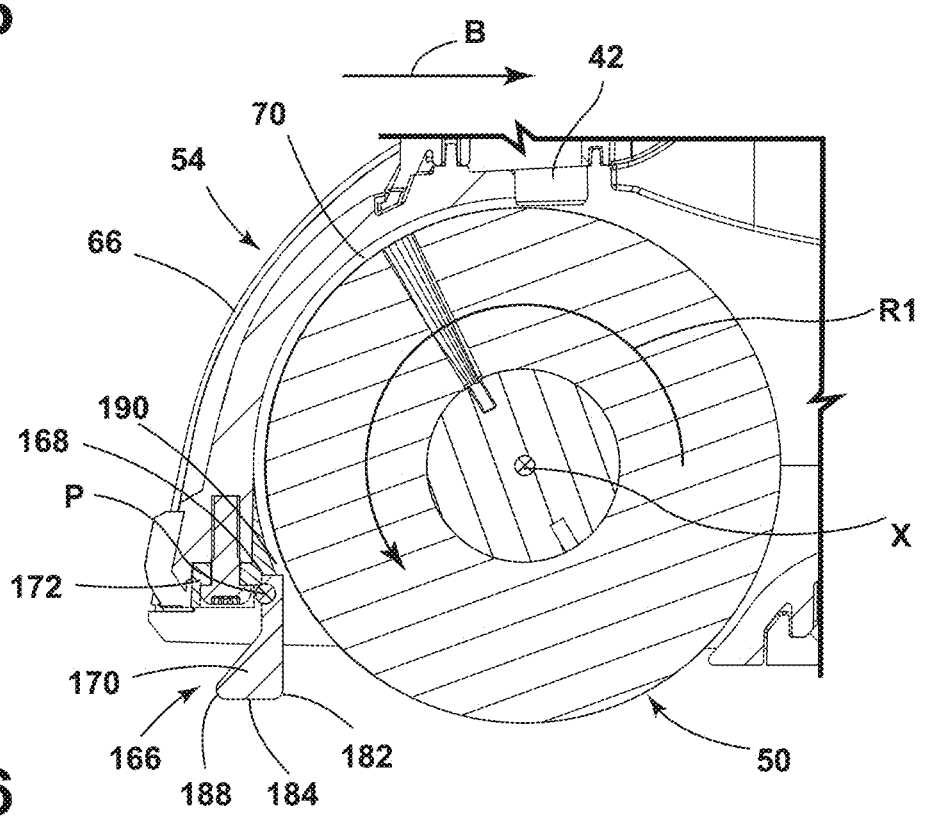
FIG. 26 is a view similar to FIG. 25, showing the cantilevered squeegee on a backward stroke of the base.

Referring to FIG. 26, on a backward stroke, the protrusion 184 release from the floor surface, allowing the squeegee 166 to bends back and bring the wiper edge 182 down. The wiper edge 182 comes into contact with the floor surface and wipes residual liquid from the surface so that it can be drawn into the recovery pathway via the suction nozzle 54, thereby leaving a moisture and streak-free finish on the surface to be cleaned.

It is noted that the deflection point P may be any point about which the free end 170 bends or flexes when subject to the forces of the forward and backward strokes of the base 14 during a cleaning operation. The bending of the squeegee 166 may depend on variables such as the type of floor surface and the speed of the base 14, and so the degree of bending and the location of the deflection point P may vary.

Figure 23:
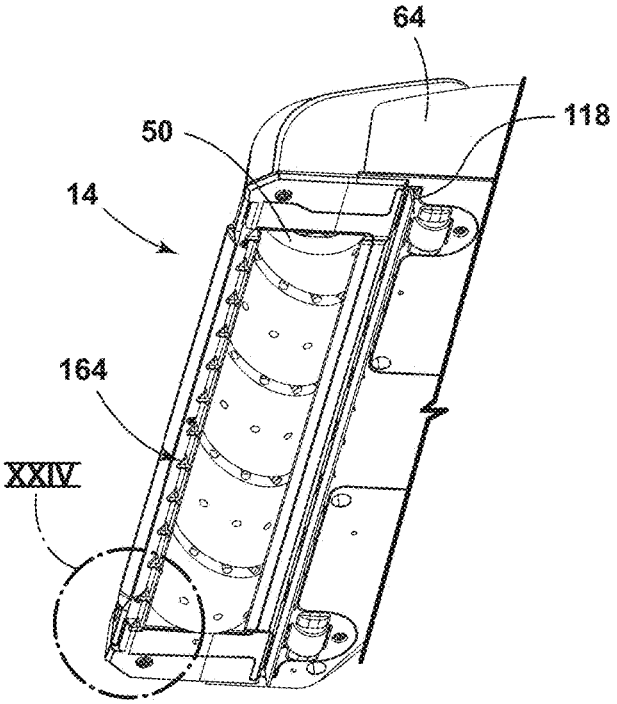
FIG. 23 is a bottom perspective view of a front portion of the base from FIG. 22.
Figure 24:
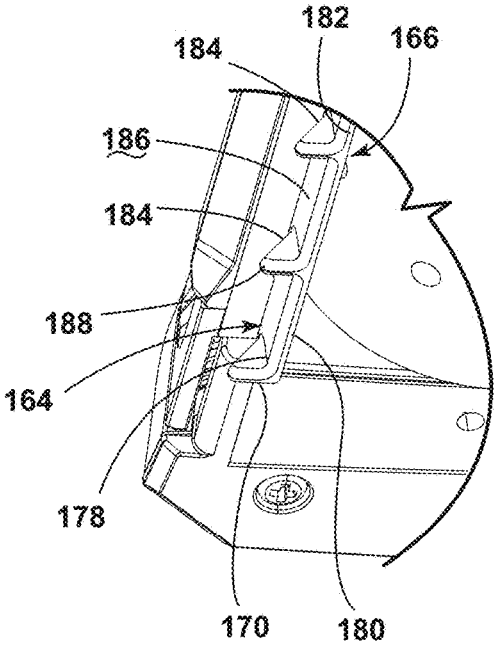
FIG. 24 is an enlarged view of section XXIII of FIG. 23.

Referring to FIG. 23, in the embodiment shown, the cantilevered squeegee 166 is provided in addition to the squeegee 118, with the squeegee 118 mounted to the base housing 64 behind the cantilevered squeegee 166, the brushroll 50, and the brush chamber 70. The squeegee 118 does not pivot as the cantilevered squeegee 166 does, but may flex back and forth on the forward and backward cleaning strokes. In other embodiments, a second squeegee 118 is not provided in addition to the cantilevered squeegee 166.

Referring to FIGS. 25-26, the squeegee 166 is disposed generally in front of and, optionally slightly below, the brushroll 50. Other locations for the squeegee 166 in relation to the brushroll 50, where the squeegee 166 does not interface with the brushroll 50, are possible. There is an air gap 190 between the squeegee 166 and the rotating brushroll 50. Preferably, the air gap 190 is small to minimize water leaks. For the embodiment shown, the air gap 190 may be on the order of 0.5 mm-1.0 mm.

FIGS. 27-30 show yet another embodiment of a base 14 for the apparatus 10. In this embodiment, the fluid distributor 42 comprises a porous spray bar 192. The porous spray bar 192 delivers liquid to the brushroll 50 across the entire length of the spray bar 192 by "weeping" pressurized cleaning formula through pores, thereby providing an even wetting distribution to the brushroll. In some embodiments, the spray bar 192 interferes with a portion of the brushroll 50 in order to compress the microfiber 88 (or other agitation material) of the brushroll 50, and forces the fibers to better distribute the liquid. This inference can also scrape off dirt and debris into the suction air flow of the suction nozzle 54.

Figure 27:
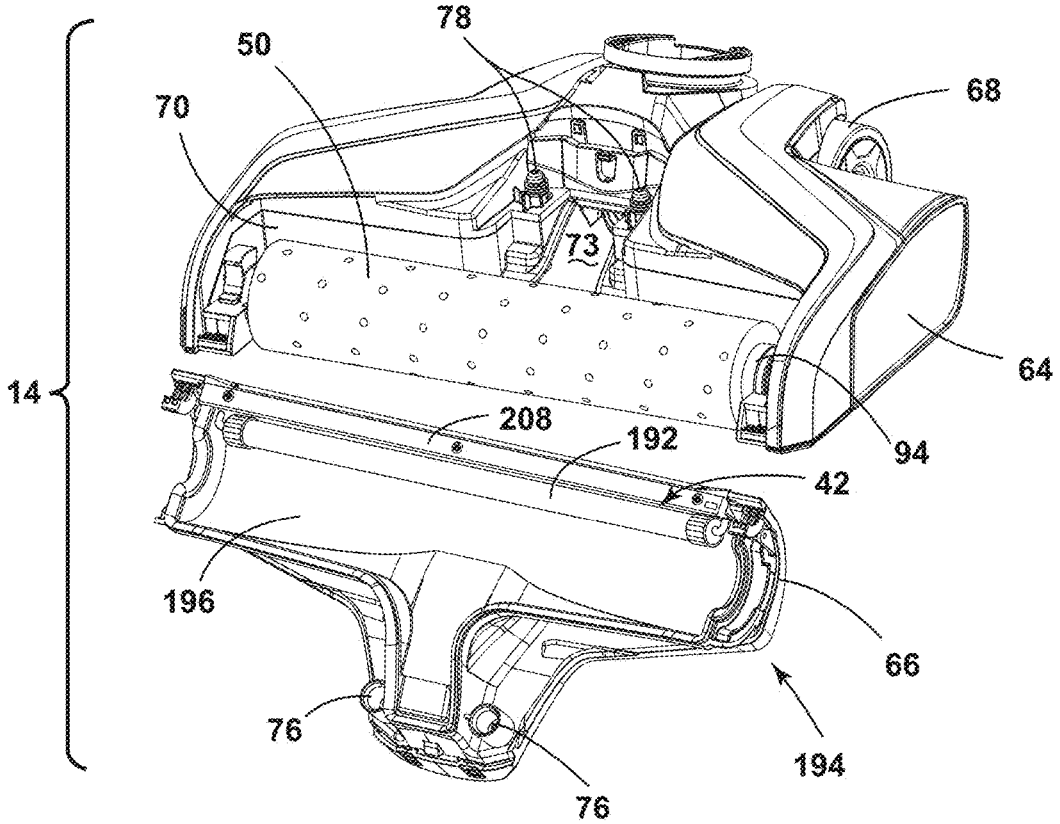
FIG. 27 is a perspective view of a base for a surface cleaning apparatus according to an aspect of the disclosure, showing a nozzle cover removed from a base housing and a porous spray bar on the nozzle cover that distributes cleaning fluid to a brushroll.

The porous spray bar 192 can be integrated with the nozzle cover 66 and forms a removable assembly 194, such that when the nozzle cover 66 is removed, the porous spray bar 192 is also removed. The entire assembly 194, e.g. the cover 66 and porous spray bar 192 is removable as a unit. FIG. 27 depicts the assembly 194 in a removed state. In the embodiment shown, the porous spray bar 192 is provided on an interior or brush-facing side 196 of the nozzle cover 66.

Figure 28:
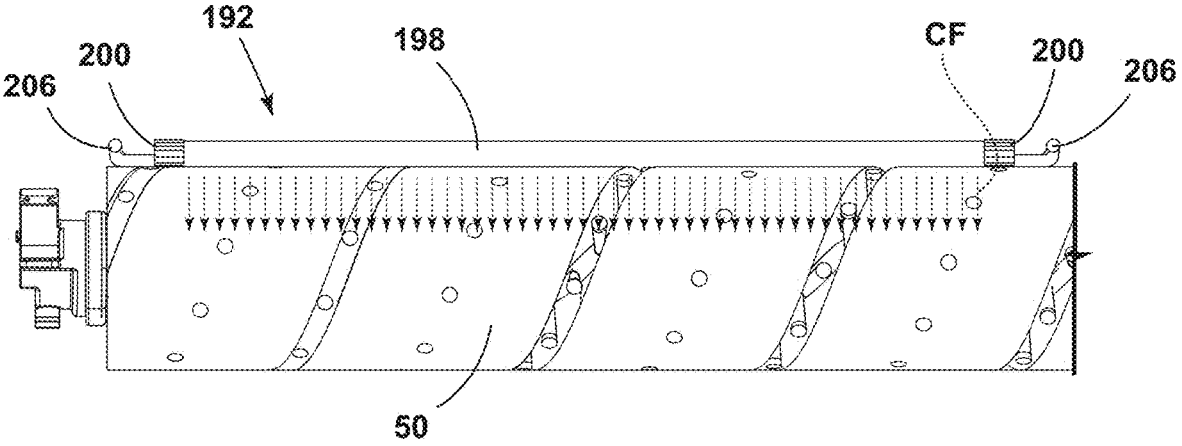
FIG. 28 is a front view of the porous spray bar and brushroll from FIG. 27 shown in isolation from the base, and showing the flow of cleaning fluid from the porous spray bar to the brushroll.

Referring to FIG. 28, the porous spray bar 192 is positioned to deliver cleaning fluid to the brushroll 50, thereby indirectly providing cleaning fluid to the floor surface. The porous spray bar 192 is elongated and comprises a tubular porous body 198 having opposing open ends 200 and defining an interior cavity 202 (FIG. 30) therein. Cleaning fluid can flow into the cavity 202 via the open ends 200, and flows outward through pores (not shown) in the body 198.

Figure 29:
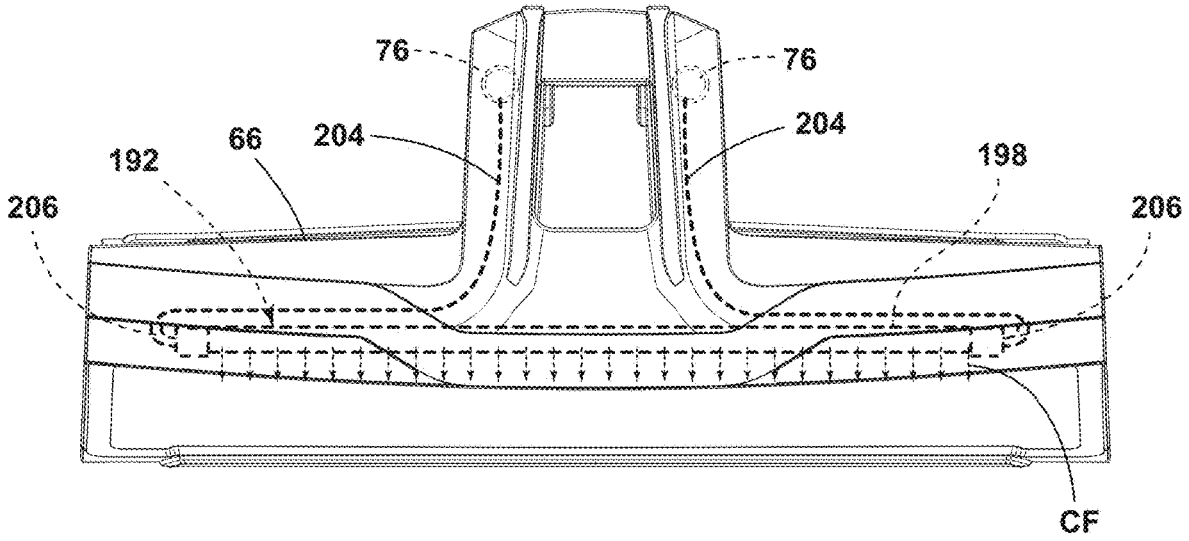
FIG. 29 is a front view of the nozzle cover showing a fluid flow path therethrough.

FIG. 29 shows a cleaning fluid flow path through the cover 66, with the flow path indicated by dashed line CF. The porous spray bar 192 is fed via channels 204 of the cover 66 which terminate in the connector ports 76 that couple with the spray connectors 78 on the base housing 64 when the cover 66 is installed on the base housing 64. The spray bar 192 can include inlet ports 206 that are fitted over or inserted into the open ends 200 of the body 198 for connection with the cover channels 204.

The porous body 198 can be manufactured from various materials such as plastic, ceramic or metal, and using various techniques. The material for the porous body 198 can be configured to release the cleaning fluid at a relatively constant flow rate in order to evenly distribute the treating agent onto the brushroll 50. One preferred example is a body 198 made from sintered plastic, producing a sintered spray bar 192.

One example of a suitable material for the porous body 198 is a porous plastic material. The porous plastic can have a suitable pore size in order to achieve a consistent, even flow rate of approximately 50-100 ml/min. The material can be configured with omnidirectional matrices of plastic that form an interconnected network of open-celled pores. The porous body 198 can be manufactured by sintering polymer pellets. Some specific examples of a suitable porous plastic are polyethylene (PE) and polypropylene (PP). More specifically, a suitable material is available from POREX® (PE or PP). Another example of a suitable material for the porous body 198 is a porous ceramic material made from alumina and/or silicon carbide (SiC).

In one embodiment, the porous body 198 can be selectively coated to precisely control the surface area where liquid delivery to the brushroll 50 is desired. The coating may be impervious to water, to liquid, and/or to the cleaning fluid that is dispensed by the porous spray bar 192 For example, a portion of the body 198 facing toward the brushroll 50 can be uncoated to allow fluid to weep through pores in this area of the body 198 and a portion of the body 198 facing away from the brushroll 50 can be coated to prevent fluid flow through pores in this area of the body 198. In one example, 25%-75% of outer surface area the body 198 can be coated, with the remainder uncoated to allow cleaning fluid to flow therethrough.

Figure 30:
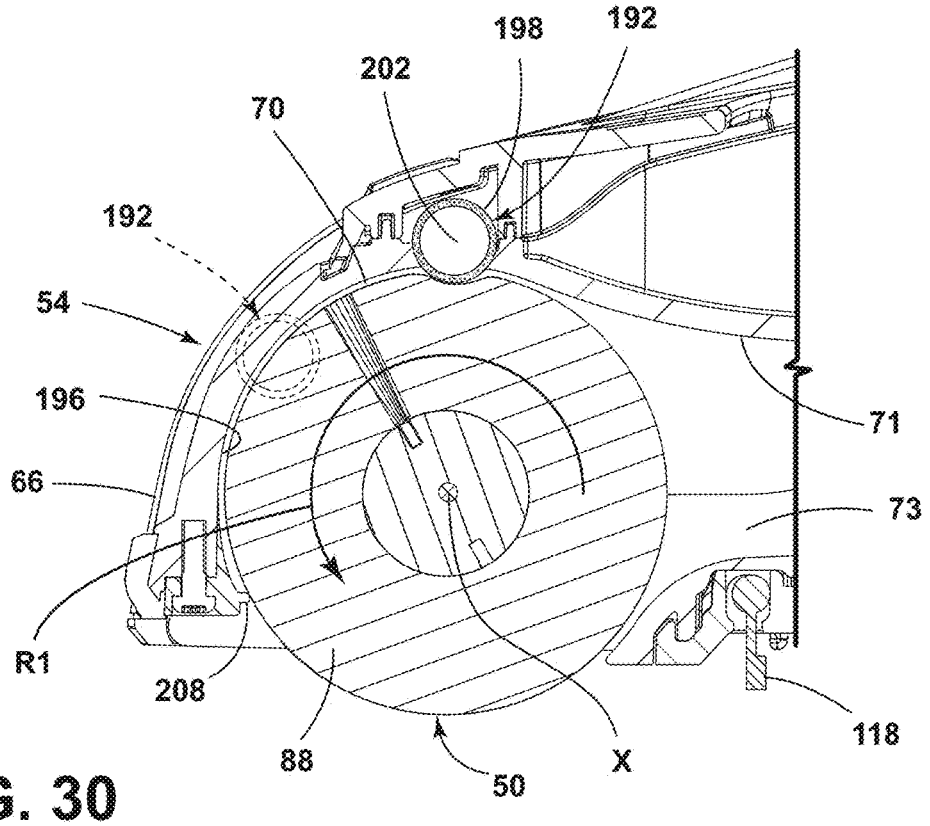
FIG. 30 is a sectional view through the base of FIG. 27, showing a forward section of the base including details of the porous spray bar and a squeegee integrated with the nozzle cover.

Referring to FIGS. 27 and 30, in the embodiment shown, a blocking member 208 is disposed at a forward portion of the brush chamber 70 and faces but does not contact the rotating brushroll 50. The blocking member 208 limits the gap at the front of the brush chamber 70 to minimize air and water leakage between the rotating brushroll 50 and the brush-facing side 196 of the nozzle cover 66. The blocking member 208 can be integrated with the nozzle cover 66 and forms the removable assembly 194 along with the cover 66 and spray bar 192. In the embodiment shown, the blocking member 208 can be a strip that projects rearward toward, but does not contact, the brushroll 50, and that is elongated laterally to extend substantially the length of the brushroll 50.

A squeegee 118 is mounted to the base housing 64 behind the brushroll 50, the brush chamber 70, and the porous spray bar 192. In other embodiments, the squeegee 118 is not provided.

Referring to FIG. 30, the porous spray bar 192 interfaces with a portion of the rotating brushroll 50 to compresses the microfiber 88 (or other agitation material) of the brushroll 50, and forces excess liquid out of the microfiber 88 before reaching the surface to be cleaned. The brush chamber 70 can have a suitable clearance such that only the porous spray bar 192 interfaces with the brushroll 50, e.g. the nozzle cover 66 and blocking member 208 do not interface with the brushroll 50.

In the embodiment shown in FIG. 30, the porous spray bar 192 is positioned to interfere with the brushroll at an approximately 12 o'clock position, relative to the circumference of the brushroll 50. In this position, the porous spray bar 192 compresses the top side of the brushroll 50. Other locations for the porous spray bar 192 in relation to the brushroll 50, where the porous spray bar 192 is configured to interface with a portion of the brushroll 50, are possible. For example, FIG. 30 shows another location of the porous spray bar 192 in phantom line, where the porous spray bar 192 is positioned to interfere with the brushroll at an approximately 10 o'clock position, and interfaces with an upper front portion of the brushroll 50.

Figure 31:
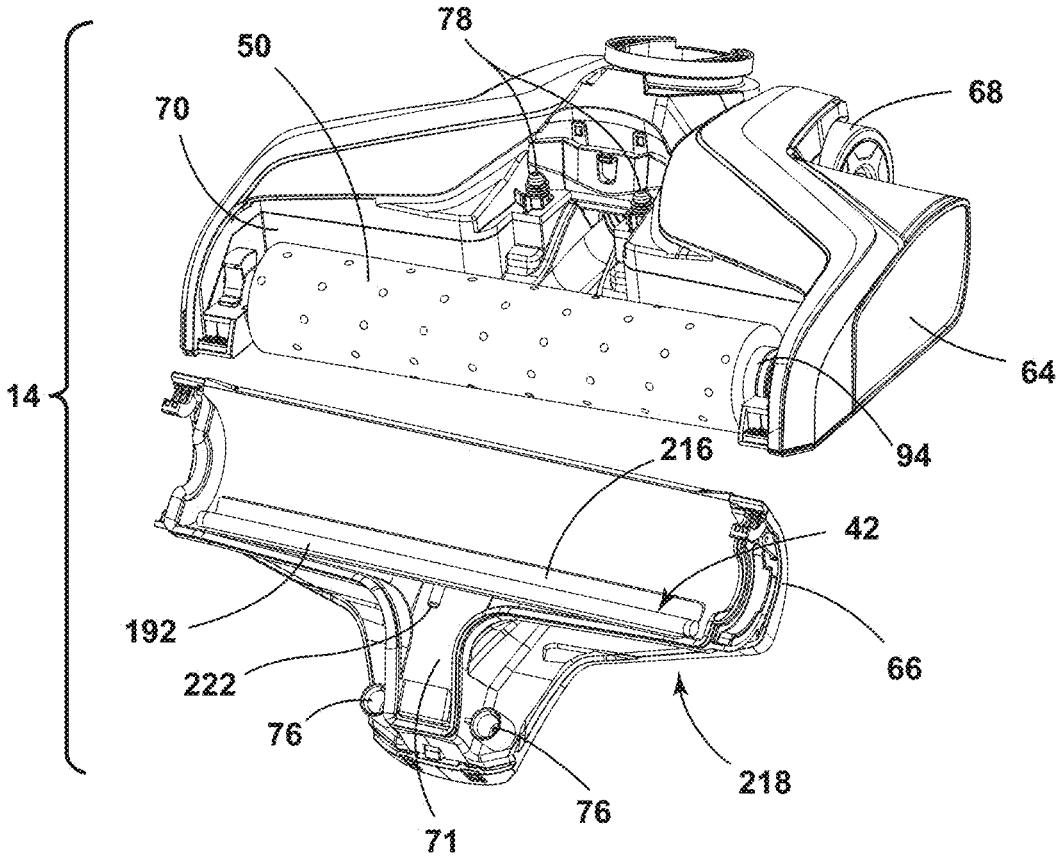
FIG. 31 is a perspective view of a base for a surface cleaning apparatus according to an aspect of the disclosure, showing a nozzle cover removed from a base housing and a porous spray bar on the nozzle cover that distributes cleaning fluid to a brushroll.
Figure 32:
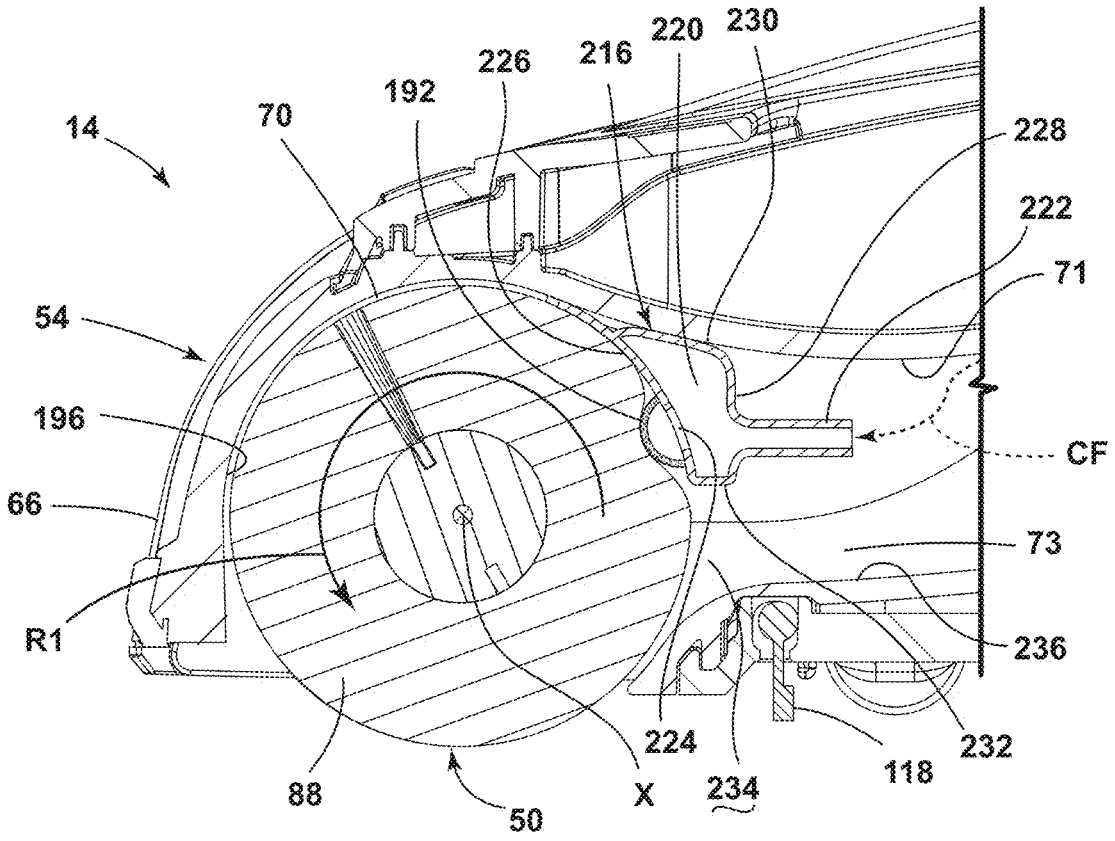
FIG. 32 is a sectional view through the base of FIG. 31, showing a forward section of the base including details of the porous spray bar and an insert integrated with the nozzle cover.

FIGS. 31-32 show yet another embodiment of a base 14 for the apparatus 10 having the porous spray bar 192. In this embodiment, the porous spray bar 192 is positioned rear of the brushroll 50, for example at an approximately 2 to 3 o'clock position, inclusive, as shown in FIG. 32, and interferes with an upper rear portion of the brushroll 50. As such, the location of fluid delivery to the brushroll 50 is closer to the suction duct 73, and given the direction of rotation R1, just after an inlet 234 to the suction duct 73.

The porous spray bar 192 is supported by an insert 216, and the insert 216 can be integrated with the nozzle cover 66 to form a removable assembly 218, such that when the nozzle cover 66 is removed, the porous spray bar 192 and insert 216 are also removed. The entire assembly 218 is removable as a unit. FIG. 31 depicts the assembly 218 in a removed state.

The porous spray bar 192 can have a semi-circular body manufactured from any of the materials or according to any of the methods disclosed for the previous embodiment, including, but not limited to, having a polymeric sintered body for a sintered spray bar 192. The spray bar can be secured to the insert 216 using various means, such as by using glue or another adhesive.

The insert 216 includes an interior fluid channel 220, at least one inlet 222 supplied with cleaning fluid via the pump 44 (FIG. 2) or other flow control system of the apparatus 10, and at least one outlet which is covered or otherwise closed by the spray bar 192, such that fluid in the channel 220 flows out of the insert 216 through the spray bar 192. In the embodiment shown, the insert 216 has a single elongated slot 224 that is covered or otherwise closed by the spray bar 192. Cleaning fluid can flow into the channel 220 via the inlet 222, and flows outward through pores (not shown) in the spray bar 192.

Referring to FIG. 32, the insert 216 includes a front wall 226, a back wall 228, a top wall 230, and a bottom wall 232 forming the channel 220. The lateral ends of the walls 226-232 can be closed by a portion of the nozzle cover 66 or by additional walls (not shown), such that the channel 220 is sealed, save for the inlet 222 and the slot 224. The walls 226-232 joined together in a generally trapezoidal shape, although other cross-sectional configurations for the insert 216 are possible.

The front wall 226 of the insert 216 faces the brushroll 50 and supports the spray bar 192. The front wall 226 can curve around, but not interfere with, a portion of the brushroll 50, and may generally follow the curvature of the brush-facing side 196 of the nozzle cover 66. The spray bar 192 projects outwardly from the front wall 226, and interferes with the brushroll 50. The inlet 222 can project from the back wall 228, or from another suitable location on the insert 216.

The insert 216 blocks off part of the airflow path behind the brushroll 50 to minimize the open area where liquid can fling off the brushroll 50 and accumulate. For example, the insert 216 can be positioned at an upper side of the duct 73, with the top wall 230 fitted tightly against the top wall 71 of the nozzle cover 66. This reduces the cross-sectional area of the inlet 234 to the duct 73 and increases the air velocity through the duct 73 for more powerful liquid recovery.

FIG. 32 shows a portion of a cleaning fluid flow path through the base 14, with the flow path indicated by dashed line CF. The insert 216 is fed via the inlet 222, which can couple with a spray connector port (not show. In the embodiment shown, an air inlet 234 of the duct 73 is defined between a lower duct wall 236 and the bottom wall 232 of the insert 216, which is disposed below the top wall 71 of the nozzle cover 66 on the base housing 64 when the cover 66 is installed on the base housing 64. Pressurized cleaning fluid weeps through the pores of the spray bar 192 to deliver cleaning fluid to the upper rear portion of the brushroll 50 across the entire length of the spray bar, thereby providing an even wetting distribution to the brushroll 50. The spray bar 192 interferes with the upper rear portion of the brushroll 50 in order to compress the microfiber 88 (or other agitation material) in this area, and force the fibers to better distribute the cleaning fluid. This inference can also scrape off dirt and debris into the suction air flow of the suction nozzle 54.

Figure 33:
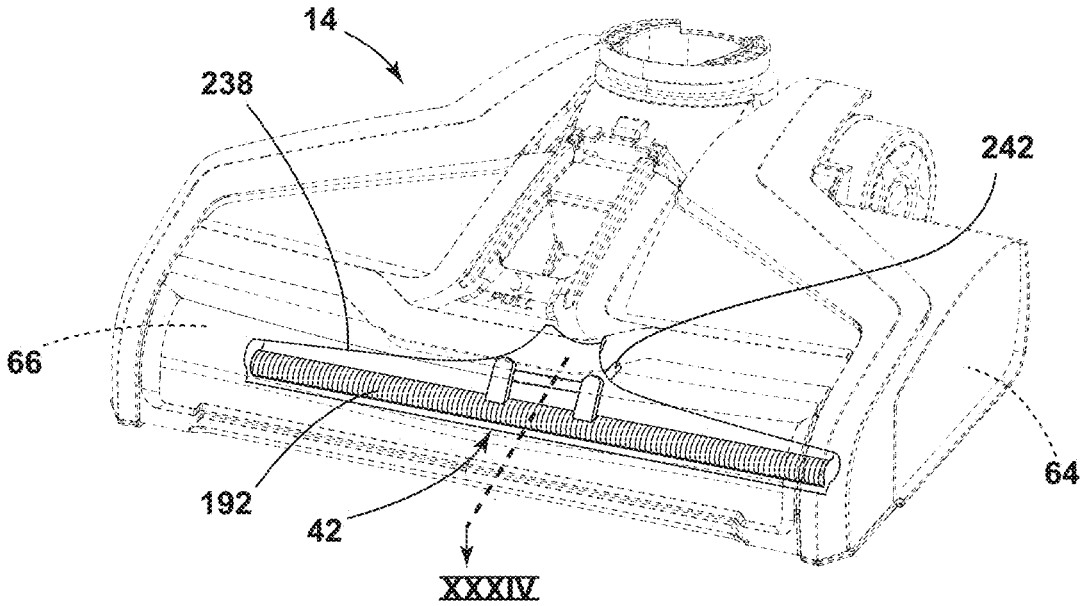
FIG. 33 is a perspective view of a base for a surface cleaning apparatus according to an aspect of the disclosure, with portions of the base in phantom line to show a porous spray bar and insert.
Figure 34:
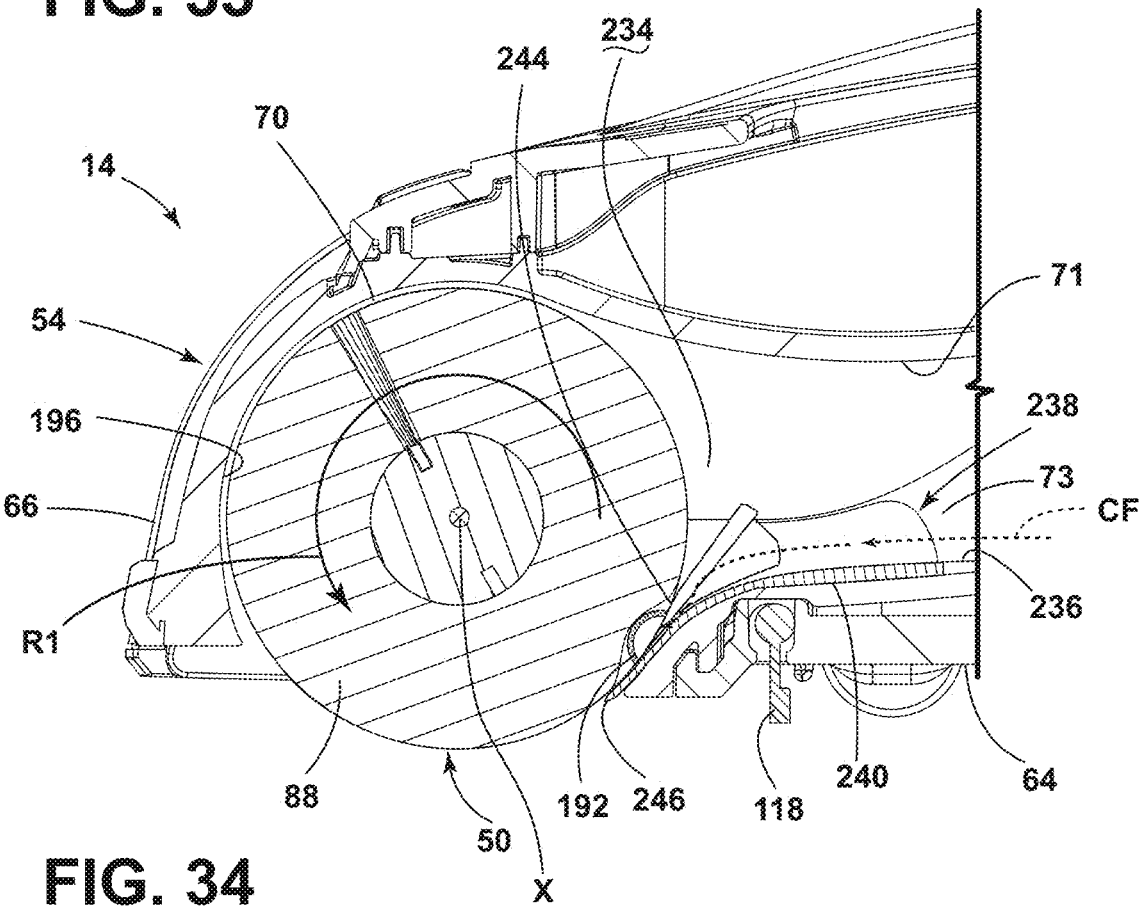
FIG. 34 is a sectional view through the line XXXIV-XXXIV of FIG. 33, showing a forward section of the base including details of the porous spray bar and insert.
Figure 35:
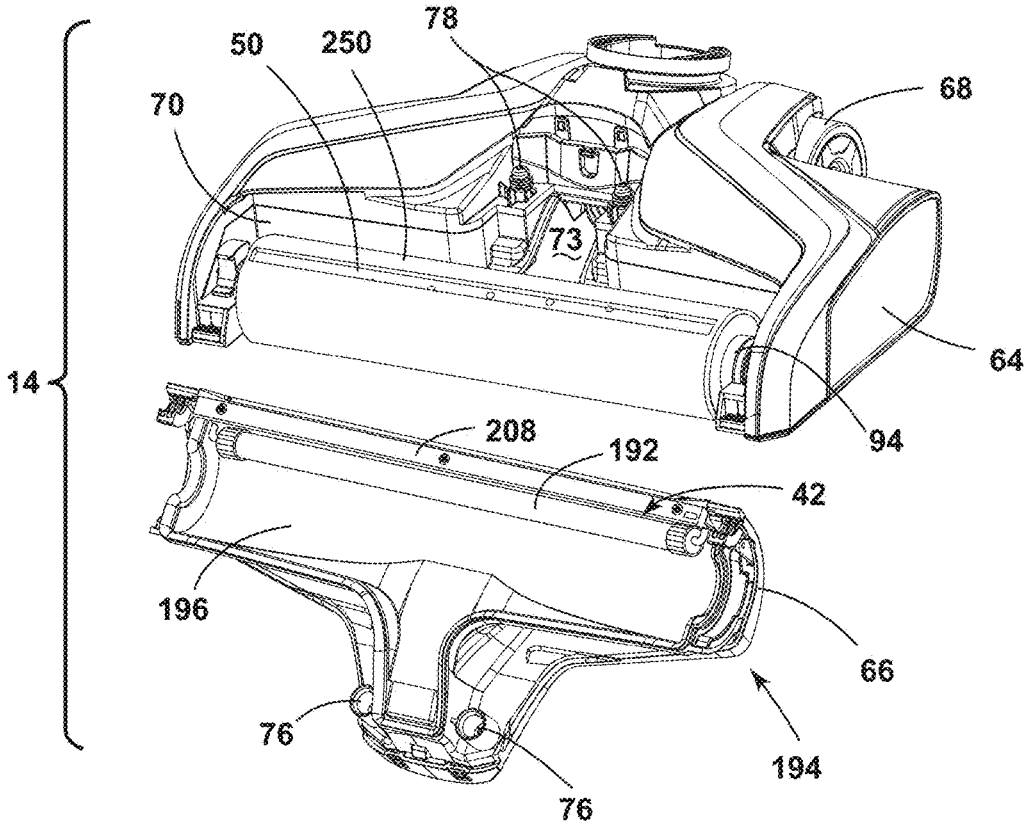
FIG. 35 is a perspective view of a base for a surface cleaning apparatus according to an aspect of the disclosure, showing a nozzle cover removed from a base housing and a fender on the brushroll.

FIGS. 33-34 show still another embodiment of a base 14 for the apparatus 10 having the porous spray bar 192. In this embodiment, the porous spray bar 192 is positioned rear of the brushroll 50, for example at an approximately 4 to 5 o'clock position, inclusive, as shown in FIG. 34, and interferes with a lower rear portion of the brushroll 50. As such, the location of fluid delivery to the brushroll 50 is closer to the suction duct 73, and given the direction of rotation R1, just before the air inlet 234 to the suction duct 73.

The porous spray bar 192 is supported by an insert 238, and the insert 238 can be positioned at a lower side of the duct 73, for example with a bottom 240 of the insert 238 fitted tightly against the bottom wall 236 of the duct 73. The insert 238 includes an interior fluid channel (not shown), at least one inlet 242 supplied with cleaning fluid via the pump 44 (FIG. 2) or other flow control system of the apparatus 10, and at least one outlet which is covered or otherwise closed by the spray bar 192, such that fluid flows out of the insert 238 through the spray bar 192.

The porous spray bar 192 can have a semi-circular body manufactured from any of the materials or according to any of the methods disclosed for the previous embodiment, including, but not limited to, having a polymeric sintered body for a sintered spray bar 192. The spray bar can be secured to the insert 238 using various means, such as by using glue or another adhesive.

The insert 238 can be integrated with the base housing 64, such that when the nozzle cover 66 and the brushroll 50 are removed, the spray bar 192 and insert 238 remain on the base housing 64. FIG. 33 depicts the base housing 64 and nozzle cover 66 in phantom line.

Referring to FIG. 34, the insert 238 can have a front wall 244 that can define a rear edge 246 of the opening into the suction nozzle 54. A portion of the insert 238 can project rearwardly into the duct 73. The spray bar 192 projects outwardly from the front wall 244, and interferes with the brushroll 50. In other embodiments, the spray bar 192 does not contact the brushroll 50.

FIG. 34 shows a portion of a cleaning fluid flow path through the base 14, with the flow path indicated by dashed line CF. Pressurized cleaning fluid weeps through the pores of the spray bar 192 to deliver cleaning fluid to the lower rear portion of the brushroll 50 across the entire length of the spray bar 192, thereby providing an even wetting distribution to the brushroll 50. With the spray bar 192 so positioned, application of the cleaning fluid to the brushroll 50 occurs just before the air inlet 234, e.g. the area where suction air flow is the strongest. As the brushroll 50 rotates, centrifugal forces act on the microfiber nap of the brushroll 50 causing the microfibers to extend radially outwardly and shed liquid and debris. The "flinging" action of the rotating brushroll 50 combined with the suction air flow removes most of the dirty liquid and debris from the brushroll 50. In other words, the brushroll 50 is rinsed off. After this rinsing, exposure to the suction air flow and the rotational speed of brushroll 50 can partially dry the brushroll. The brushroll 50 remains damp enough to clean the floor but does not over-wet or leave streaks on the floor.

FIGS. 35-38 show still another embodiment of a base 14 for the apparatus 10 having a fender 250 surrounding the brushroll 50. The fender 250 includes a fender wall 254 that extends partially around the outer circumference of the brushroll 50. The fluid distributor 42 dispenses cleaning fluid to the brushroll 50 through a slot 256 in the fender wall 254. In this embodiment, the fluid distributor 42 comprises a porous spray bar 192 as described with respect to FIGS. 27-30. Other fluid distributors are possible.

The fender 250 helps to confine liquid that is dispensed onto and/or flung off the brushroll 50 to the area within the fender 250. The liquid inside the fender 250 can be absorbed by the microfiber nap of the brushroll 50, wetting the brushroll 50 evenly to wipe over the floor at the open lower side of the fender 250.

Figure 36:
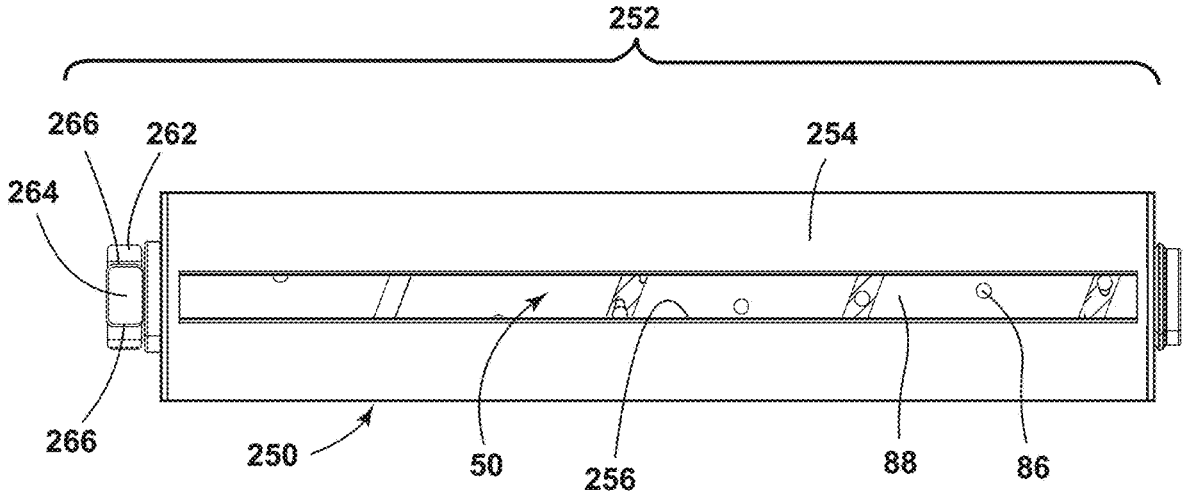
FIG. 36 is a top perspective view of an assembly including a brushroll and the fender from FIG. 35.
Figure 37:
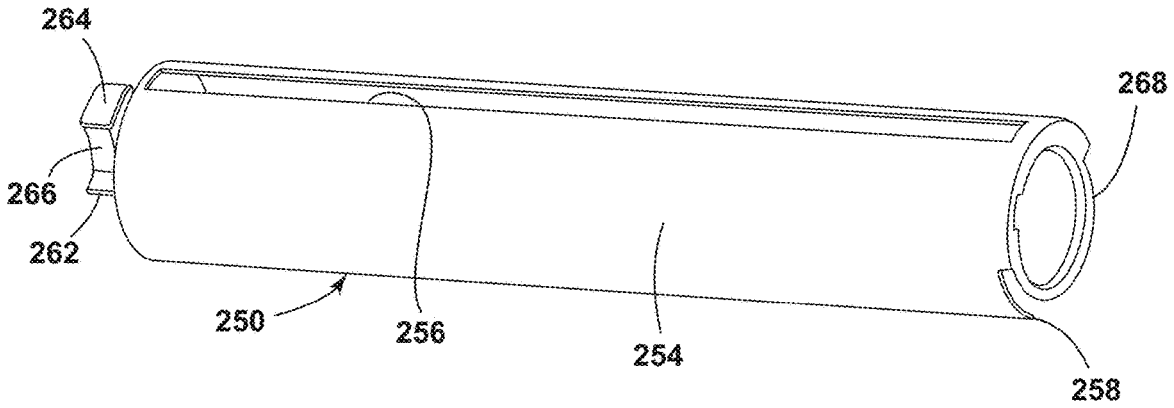
FIG. 37 is a front perspective view of the fender from FIG. 35.

The fender 250 can be integrated with the brushroll 50 and forms an assembly 252, with the assembly 252 being removable from the base housing 64 as a unit. When the nozzle cover 66 is removed, the fender 250 and brushroll 50 remain on the base 14. FIG. 36 depicts the assembly 252 in a removed state. When removed, the brushroll 50 can be separated from the fender 250. This permits the brushroll 50 and fender 250 to be thoroughly cleaned, and permits either component to be replaced individually, rather than having to replace the entire assembly 252 when one component reaches the end of its useful life. As depicted in FIG. 36, the fender 250 can be used with a hybrid brushroll as described herein, or with other types of brushrolls.

Figure 38:
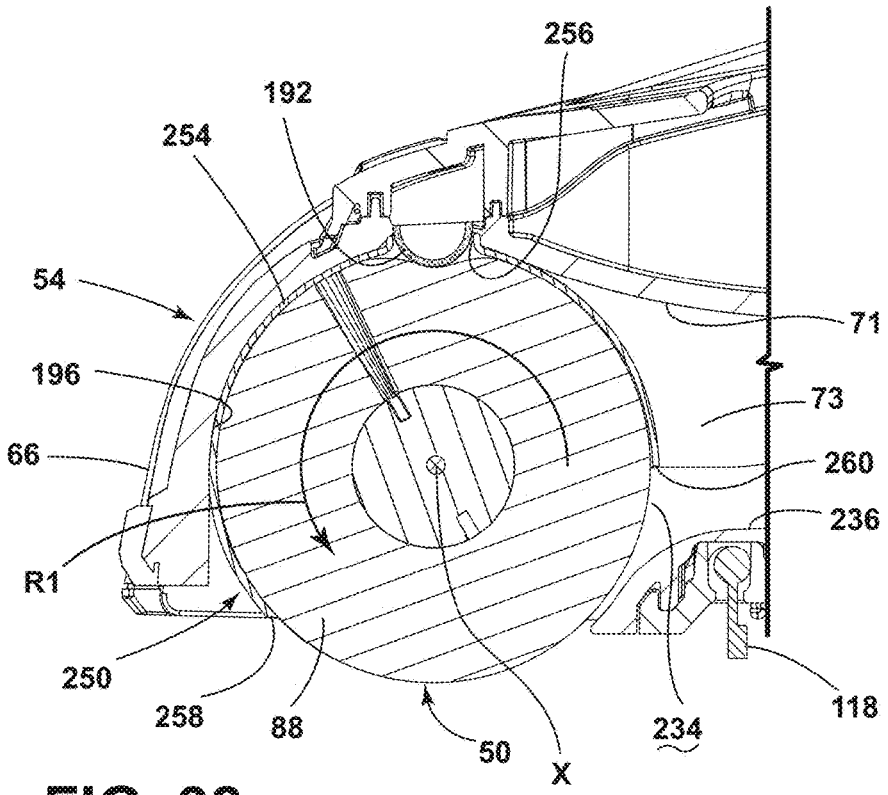
FIG. 38 is a sectional view through the base of FIG. 35, showing a forward section of the base including details of the fender.

The fender wall 254 terminates in a front edge 258 on a front side of the brushroll 50 and terminates in a rear edge 260 on a rear side of the brushroll 50 to expose the lower portion of the brushroll 50 for contact with the surface to be cleaned. As can be seen in FIG. 38, the rear edge 260 can be higher than the front edge 258 to expose a greater portion of the brushroll 50 at its rear side, toward the duct 73. In the embodiment shown, the air inlet 234 of the duct 73 is defined between the rear edge 260 of the fender 250 and the lower wall 236 of the duct 73.

The fender 250 can include an end cap 262 at a first end thereof, and which can be integrally formed with or otherwise attached to the fender wall 254 such that the end cap 262 is removable from the brushroll 50 with the fender wall 254. To mount the fender 250 to the brushroll 50, an outer race of the bearing 92 (FIG. 7) is fixed in the end cap 262.

The assembly 252 can be secured in the brush chamber 70 by a latch. Various configurations for the latch are possible. For example, the latch may be substantially similar to the latch described above with respect to FIGS. 8 and 10, with a portion of the latch provided on the end cap 262 and a mating portion provided in the brush chamber 70.

The fender 250 can include a handle 264 to aid in removing the assembly 252 from the brush chamber 70. The handle 264 can optionally include indents 266 in the sides of the handle 264 to assist in gripping the handle 264 to lift the assembly 252. The indents 266 can, for example, by pinched between the thumb and forefinger of the user.

In the embodiment shown, the handle 264 can be integrally formed with or otherwise attached to the end cap 262, and can project upwardly from the end cap 262 when the assembly 252 is seated in the brush chamber 70 (see FIG. 35) so that a user can grip the handle 264 to lift the assembly 252 up.

To accommodate the drive coupling between the driven end of the brushroll 50 and drive assembly 74 (FIG. 3), the fender 250 can include a cap ring 268 at a second end thereof. The cap ring 268 can be integrally formed with or otherwise attached to the fender wall 254 such that the cap ring 268 is removable from the brushroll 50 with the fender wall 254. The cap ring 268 can have a larger inner diameter than an outer diameter of the drive end cap 94.

To support the second end of the fender 250, the cap ring 268 is fitted over a portion of the drive assembly 74, such as the hub 108 (FIG. 9). Like the embodiment discussed above with respect to FIG. 9, the cap ring 268 can be chamfered for easy lead-in when installing the assembly 252 in the brush chamber 70.

Referring to FIGS. 38, the fender 250 can have a suitable clearance with the brushroll 50 such that the fender wall 254 does not contact the brushroll 50. The nozzle cover 66 can provide a suitable clearance for the fender 250 such that the fender wall 254 does not contact the brush-facing side 196 of the nozzle cover 66.

The spray bar 192 dispenses cleaning fluid to the brushroll 50 through the slot 256 in the fender wall 254. The spray bar 192 can be aligned with and can project at least partially through the slot 256 to ensure that cleaning fluid reaches the brushroll 50, rather than leaking out over the outer side of the fender wall 254.

Through the slot 256, the porous spray bar 192 can interface with a portion of the rotating brushroll 50 to compresses the microfiber 88 (or other agitation material) of the brushroll 50, and forces excess liquid out of the microfiber 88 before reaching the surface to be cleaned. In other embodiments, the spray bar 192 does not contact the brushroll 50.

Figure 39:
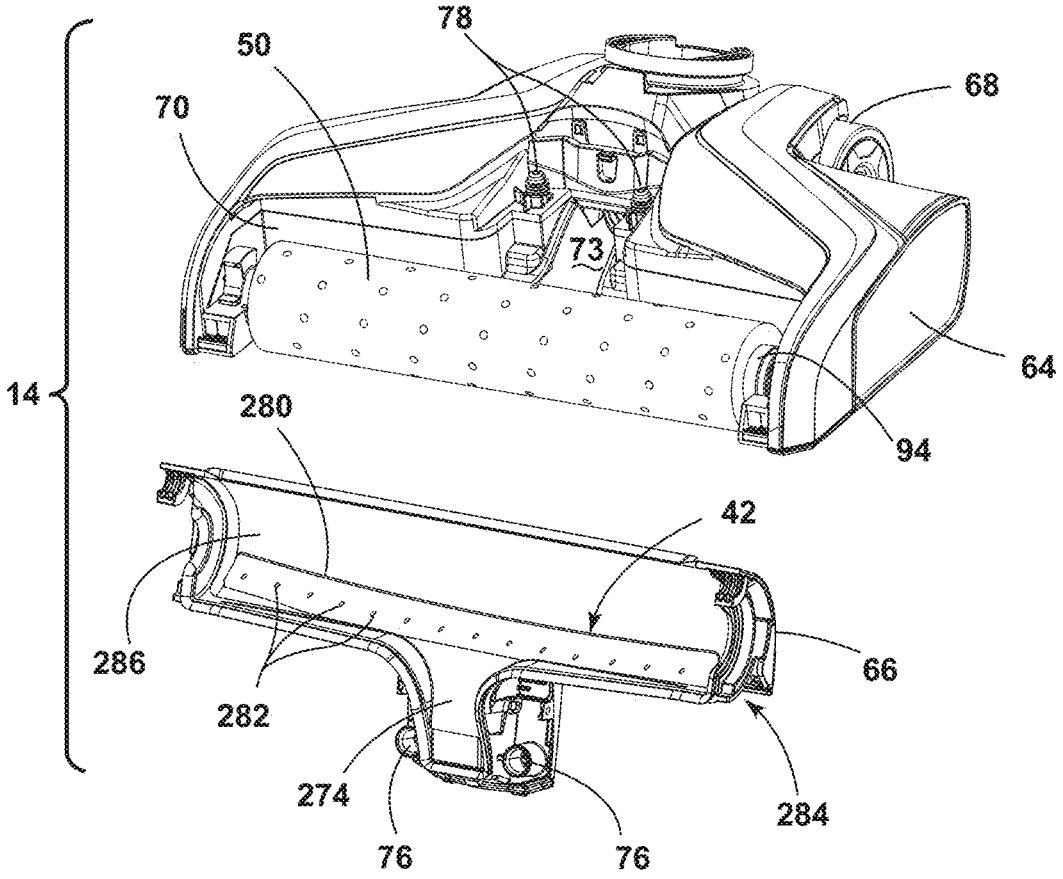
FIG. 39 is a perspective view of a base for a surface cleaning apparatus according to an aspect of the disclosure, showing a nozzle cover removed from a base housing and a fluid dispenser on the nozzle cover.
Figure 40:
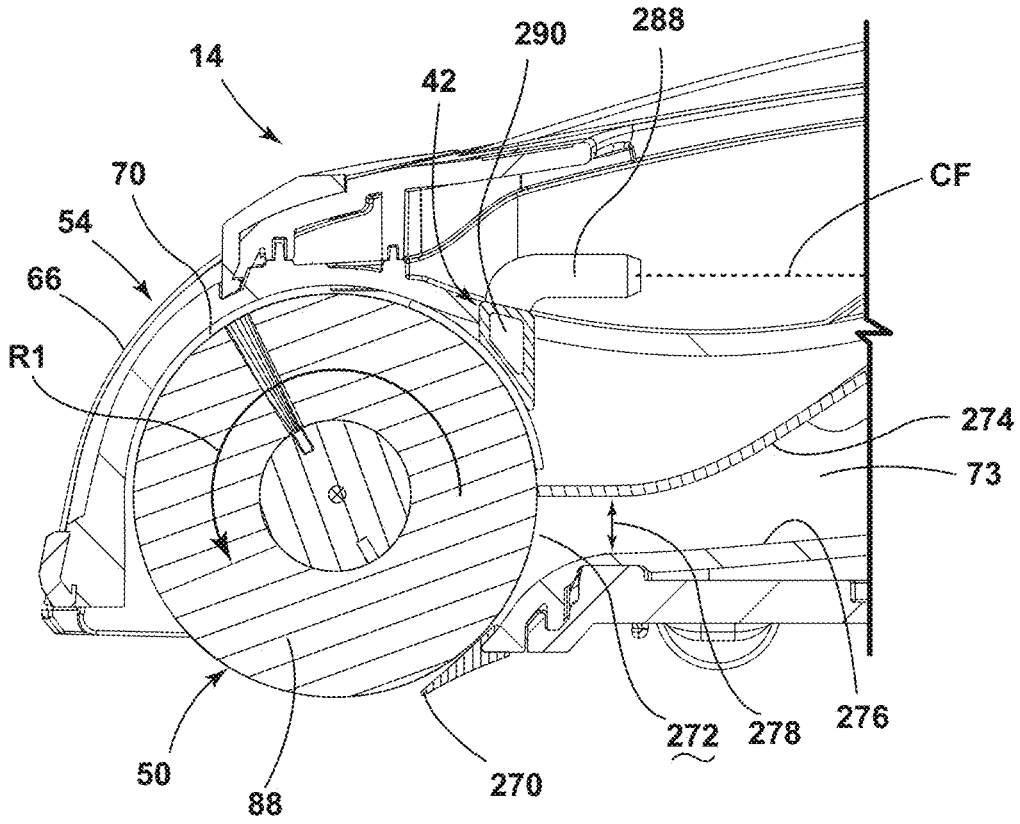
FIG. 40 is a sectional view through the base of FIG. 39, showing a forward section of the base including details of an angled squeegee and a suction duct having a narrowed inlet.

FIGS. 39-40 show yet another embodiment of a base 14 for the apparatus 10 having a restricted air flow path for the suction duct 73 to increase air velocity within the brush chamber 70 and an angled squeegee 270.

In the embodiment shown, an inlet 272 of the duct 73 is defined between a lower duct wall 274 and an upper duct wall 276 which is formed by a bottom or underside of the nozzle cover 66. The duct 73 can include a narrowed section 278 downstream of the inlet 272. The narrowed section 278 can be formed by a portion of the upper duct wall 274 that converges toward, and then diverges away from, the lower duct wall 276. Alternatively or additionally, the narrowed section 278 can be formed by a portion of the lower duct wall 276 that converges toward, and then diverges away from, the upper duct wall 274.

The angled squeegee 270 can be mounted to the base housing 64 behind the brushroll 50 and the brush chamber 70 and is configured to contact the surface as the base 14 moves across the surface to be cleaned. The squeegee 270 wipes residual liquid from the surface to be cleaned so that it can be drawn into the recovery pathway via the suction nozzle 54, thereby leaving a moisture and streak-free finish on the surface to be cleaned.

The angled squeegee 270 is disposed obliquely to the surface to be cleaned, or at an incline rising toward the suction duct 73. The squeegee 270 can, in one embodiment, project forwardly from the lower duct wall 276, and may project under a rear portion of the brushroll 50. The angled squeegee 270 does not contact the brushroll 50, and instead is configured to provide a suction seal between the suction nozzle 54 and the floor surface, while allowing large debris to enter the suction nozzle 54, on a forward stroke of the base 14, and wipes the floor to prevent water puddles on a backward stroke of the base 14.

The squeegee 270 is pliant, i.e. flexible or resilient, in order to bend readily according to the contour of the surface to be cleaned yet remain undeformed by normal use of the apparatus 10, and may be formed of any of the materials disclosed above with respect to squeegee 118 (FIG. 5).

In this embodiment, the fluid distributor 42 comprises a manifold 280 having multiple outlets 282 that distribute cleaning fluid to the brushroll 50. The manifold 280 is positioned rear of the brushroll 50, for example at an approximately 2 to 3 o'clock position, inclusive, as shown in FIG. 40. As such, the location of fluid delivery to the brushroll 50 is closer to the suction duct 73, and given the direction of rotation R1, just after the inlet 272 to the suction duct 73. The manifold 280 is therefore disposed above the inlet 272, and the squeegee is disposed below the inlet 272.

The manifold 280 can be integrated with the nozzle cover 66 and forms a removable assembly 284, such that when the nozzle cover 66 is removed, the manifold 280 is also removed. The entire assembly 284 is removable as a unit. FIG. 39 depicts the assembly 284 in a removed state. In the embodiment shown, the manifold 280 is provided on an interior or brush-facing side 286 of the nozzle cover 66.

The manifold 280 can include inlet ports 288, one of which is visible in FIG. 40, that feed cleaning fluid to the outlets 282 via an interior supply channel 290 of the manifold 280. A flow path, indicated by dashed line CF, can fluidly couple the inlet ports 288 with the connector ports 76 (FIG. 39) that couple with the spray connectors 78 on the base housing 64 when the cover 66 is installed on the base housing 64. The manifold 280 does not engage or interfere with the brushroll 50. Other fluid distributors are possible, including a sintered spray bar.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Furthermore, while the surface cleaning apparatus 10 shown herein has an upright configuration, the surface cleaning apparatus can be configured as a canister or portable unit. For example, in a canister arrangement, foot components such as the suction nozzle and brushroll can be provided on a cleaning head coupled with a canister unit. Still further, the surface cleaning apparatus can additionally have steam delivery capability. Thus, the various features of the different embodiments may be mixed and matched in various vacuum cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus comprising:

a base comprising a base housing at least partially forming a brush chamber;

a nozzle cover coupled with the base housing, the nozzle cover closing the brush chamber;

a brushroll positioned within the brush chamber; and a fluid distributor comprising a porous spray bar configured to deliver cleaning fluid onto the brushroll;

wherein the porous spray bar is integrated with one of the nozzle cover and the base; and wherein the porous spray bar is positioned to interfere with the brushroll.

2. The surface cleaning apparatus of claim 1, wherein the porous spray bar is elongated and comprises a tubular porous body defining an interior cavity therein and having a pore size configured to dispense cleaning fluid at a flow rate of 50-100 ml/min, whereby cleaning fluid in the interior cavity can flow outward through the tubular porous body.

3. The surface cleaning apparatus of claim 1, wherein the porous spray bar comprises a porous body defining an interior cavity therein and having a pore size configured to dispense cleaning fluid at a flow rate of 50-100 ml/min, whereby cleaning fluid in the interior cavity can flow outward through the porous body.

4. The surface cleaning apparatus of claim 1, wherein the porous spray bar comprises:

an elongated porous body having opposed open ends and defining an interior cavity therein; and inlet ports coupled with the open ends of the porous body, whereby cleaning fluid flows into the interior cavity via the inlet ports and flows out of the interior cavity through pores in the porous body.

5. The surface cleaning apparatus of claim 1, wherein the porous spray bar comprises:

a porous body having a portion facing the brushroll and a portion facing away from the brushroll; and a coating on the portion of the porous body facing away from the brushroll to defines a coated portion of the porous body;

wherein the coating is impervious to the cleaning fluid that is delivered by the porous spray bar to prevent cleaning fluid from flowing through the coated portion of the porous body.

6. The surface cleaning apparatus of claim 1, wherein the nozzle cover comprises a blocking member on a brushroll-facing side of the nozzle cover disposed at a forward portion of the brush chamber, the blocking member projecting rearward toward the brushroll and not contacting the brushroll to minimize air and water leakage between the brushroll and the brushroll-facing side of the nozzle cover.

7. The surface cleaning apparatus of claim 1, wherein the porous spray bar is integrated with the base and the nozzle cover is removable from the base housing without removing the porous spray bar from the base.

8. The surface cleaning apparatus of claim 1, wherein the porous spray bar is integrated with the nozzle cover and the nozzle cover and the porous spray bar form an assembly that is removable from the base housing as a unit.

9. The surface cleaning apparatus of claim 8, wherein the nozzle cover comprises at least one fluid channel supplying cleaning fluid to the porous spray bar.

10. The surface cleaning apparatus of claim 1, comprising a duct forming a portion of a recovery pathway, the duct extending from a rear side of the brush chamber and comprising an inlet.

11. The surface cleaning apparatus of claim 10, wherein the porous spray bar is positioned above the inlet to the duct such that a portion of the brushroll wetted with cleaning fluid from the porous spray bar rotates past a surface to be cleaned below the base before reaching the duct.

12. The surface cleaning apparatus of claim 10, wherein the porous spray bar is positioned forward of the inlet to the duct such that a portion of the brushroll wetted with cleaning fluid from the porous spray bar rotates past a surface to be cleaned below the base before reaching the duct.

13. The surface cleaning apparatus of claim 10, comprising an insert supporting the porous spray bar, the insert comprising:

a fluid channel;

at least one inlet to the fluid channel in fluid communication with a source of pressurized cleaning fluid; and at least one outlet covered by the porous spray bar such that cleaning fluid in the fluid channel flows out of the insert through the porous spray bar;

wherein the insert blocks part of the duct to reduce a cross-sectional area of the inlet to the duct.

14. The surface cleaning apparatus of claim 1, comprising a fender around the brushroll, the fender comprising:

a fender wall that extends partially around an outer circumference of the brushroll; and a slot in the fender wall;

wherein the porous spray bar is integrated with the one of the nozzle cover and the base at a location outside of the fender wall and wherein the porous spray bar protrudes through the slot in the fender wall to interfere with the brushroll and dispense cleaning fluid to the brushroll through the slot in the fender wall.

15. The surface cleaning apparatus of claim 1, wherein the brushroll is removable from the base housing.

16. The surface cleaning apparatus of claim 1, wherein the brushroll comprises a microfiber material, and the porous spray bar is positioned to compress the microfiber material.

17. The surface cleaning apparatus of claim 1, wherein the brushroll comprises a brush bar, bristles extending from the brush bar, and microfiber material provided between the bristles, and the porous spray bar is positioned to interfere with the bristles and microfiber material.

18. The surface cleaning apparatus of claim 1, comprising a recovery system including a recovery pathway, a recovery tank, and a suction source configured to generate a working air stream through the recovery pathway, wherein the brush chamber defines a portion of the recovery pathway and the brushroll is within the recovery pathway.

19. The surface cleaning apparatus of claim 1, comprising a cleaning fluid delivery system including a supply tank in fluid communication with the porous spray bar.

20. The surface cleaning apparatus of claim 1, comprising an upright body coupled with the base, the upright body comprising a handle, and at least one of:

a trigger controlling the delivery of fluid from the porous spray bar;

a supply tank configured to hold cleaning fluid;

a recovery tank configured to store liquid and debris removed from a surface to be cleaned;

a suction source selectively generating a working air stream in a recovery pathway;

a pump selectively pressurizing a fluid pathway supplying cleaning fluid to the porous spray bar;

a joint assembly pivotally coupling the upright body to the base for movement of the upright body about at least one axis.

* * * * *